US008013249B2

(12) United States Patent
Watanabe et al.

(10) Patent No.: US 8,013,249 B2
(45) Date of Patent: Sep. 6, 2011

(54) SHIELD CONDUCTOR AND SHIELD CONDUCTOR MANUFACTURING METHOD

(75) Inventors: Kunihiko Watanabe, Yokkaichi (JP); Hideo Miyaki, Yokkaichi (JP); Katsutoshi Izawa, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 80 days.

(21) Appl. No.: 12/312,466

(22) PCT Filed: Nov. 23, 2007

(86) PCT No.: PCT/JP2007/072697
§ 371 (c)(1),
(2), (4) Date: May 12, 2009

(87) PCT Pub. No.: WO2008/062885
PCT Pub. Date: May 29, 2008

(65) Prior Publication Data

US 2009/0294149 A1 Dec. 3, 2009

(30) Foreign Application Priority Data

Nov. 24, 2006 (JP) ..... 2006-317667
Sep. 19, 2007 (JP) ..... 2007-242545
Nov. 8, 2007 (JP) ..... 2007-290985

(51) Int. Cl.
*H01R 9/05* (2006.01)

(52) U.S. Cl. ..... 174/75 C; 174/102 R; 174/78

(58) Field of Classification Search ..... 174/102 R, 174/75 C, 78, 88 C
See application file for complete search history.

(56) References Cited

U.S. PATENT DOCUMENTS 3,745,230 A * 7/1973 Kelly ..... 174/103
6,031,185 A * 2/2000 Bouveret et al. ..... 174/84 R
6,203,376 B1 * 3/2001 Magajne et al. ..... 439/607.44
6,417,452 B1 7/2002 Doshita
6,491,545 B1 * 12/2002 Spiegel et al. ..... 439/579
6,595,789 B2 * 7/2003 Oota et al. ..... 439/98
7,094,970 B2 8/2006 Kihira
2007/0095555 A1 * 5/2007 Venaleck ..... 174/75 C

FOREIGN PATENT DOCUMENTS

DE 10354284 (A1) 6/2004

(Continued)

OTHER PUBLICATIONS

Translation of Mar. 22, 2011 Office Action issued in Chinese Patent Application No. 200780043219.8.

(Continued)

*Primary Examiner* — Chau N Nguyen
(74) *Attorney, Agent, or Firm* — Oliff & Berridge, PLC

(57) ABSTRACT

A shield conductor Wa comprises: a metallic pipe 20, a wire 10 to be inserted into the pipe 20, and a groove-like fitting member 22 provided in the pipe 20 as extending along the direction of axis of the wire 10, and at the same time, attached tightly to the circumference of the wire. With the inner surface of the groove-like fitting member 22 in the pipe 20 attached tightly to the circumference of the wire 10, the heat generated in the wire 10 is transmitted directly to the pipe 20, and then released to the air from the circumference of the pipe 20. This improves radiation performance of the shield conductor Wa.

17 Claims, 30 Drawing Sheets

FOREIGN PATENT DOCUMENTS

| | | |
|---|---|---|
| EP | 1 688 966 (A1) | 8/2006 |
| JP | U-59-003430 | 1/1984 |
| JP | U-01-174815 | 12/1989 |
| JP | A-2004-171952 | 6/2004 |
| JP | A-2005-044607 | 2/2005 |
| JP | A-2006-260898 | 9/2006 |
| JP | A-2006-269201 | 10/2006 |
| JP | A-2007-149550 | 6/2007 |
| WO | WO 2006/107050 A1 | 10/2006 |
| WO | WO 2006/118273 A1 | 11/2006 |

OTHER PUBLICATIONS

Office Action issued on Jun. 14, 2011 in German Application No. 112007002801.7 (English Language Translation attached).

* cited by examiner

SHIELD CONDUCTOR AND SHIELD CONDUCTOR MANUFACTURING METHOD

TECHNICAL FIELD

The present invention relates to a shield conductor and a shield conductor manufacturing method.

BACKGROUND ART

As a shield conductor using a non-shielded wire, there has been one collectively shielding a plurality of non-shielded wires by enwrapping with a shielding member composed of a tubular braided wire made of metal thin wires woven into meshes. As a protecting method for shielding members and wires in this kind of shield conductor, means for enwrapping shielding members with a protector made from synthetic resin has been generally known. However, using a protector causes an increased number of parts.

Considering the foregoing, the applicant of the present application has suggested, as described in Patent Literature 1, a structure wherein a non-shielded wire is inserted into a metal pipe. According to this configuration, the pipe fulfills functions of shielding and protecting wires, and it is therefore advantageous that the configuration requires fewer number of parts, compared to a shield conductor using a shielding member and a protector.

[Patent literature 1]: Japanese Unexamined Patent Publication No. 2004-171952

In a shield conductor using a pipe, an air layer exists between wires and the pipe, and it is therefore difficult for heat generated in wires at the time of energizing to be transmitted to the pipe since the heat is cut off by air of low heat conductivity. Moreover, since no venting pathway to the outside, like the clearance between knitted stitches in braided wires, exists in the pipe, heat generated in the wires is easily confined inside of the pipe. Therefore, a shield conductor using a pipe tends to have a lower radiation performance.

Here, the heating value at the time of applying a prescribed electrical current to a conductor is lower when a cross-section area of the conductor is larger, while a temperature rise value of the conductor caused by heat generation is more restrained when the radiation performance of the electrically-conducting path is higher. Consequently, in an environment where the upper limit of the temperature rise value of the conductor is decided, and in a shield conductor of low radiation efficiency as mentioned above, it is necessary to restrain a heating value by enlarging the cross-section area of the conductor.

However, enlarging the cross-section area of a conductor means an increased diameter and weight of the shield conductor, and therefore requiring a countermeasure.

Thus, there is a need in the art for an improve radiation performance of a shield conductor.

SUMMARY

As means to achieve the above objects, a shield conductor according to the present invention comprises: a metal pipe, a wire to be inserted into the pipe, and a groove-like fitting member provided in the pipe as extending along a direction of axis of the wire and attached tightly to the circumference of the wire.

In addition, the present invention relates to a shield conductor manufacturing method which executes: a process for forming a plurality of metallic plate shaped composing members having a groove-like fitting member, a process for externally fitting the groove-like fitting member to a wire, and a process for constituting a pipe by combining the plate shaped composing member so as to enwrap the wire.

With the inner surface of the groove-like fitting member of the pipe attached tightly to the circumference of the wire, the heat generated in the wires is transmitted directly to the pipe, and then released to the air from the circumference of the pipe. The present invention excels in radiation performance, compared with the one constituted so that the greater part of the heat generated in wires is transmitted to the pipe through air layer.

In addition, a groove-like fitting member to be attached tightly to the circumference of the wire is formed in the pipe, so that the wire can be positioned with respect to the pipe. This improves the workability at the time of assembling the pipe and the wire.

The following configurations are preferred as the embodiment of the present invention.

The wire is used for supplying an electric power for motive power of a vehicle, and the pipe may be arranged under the floor of a car body of the vehicle.

According to the above configuration, the pipe has a protecting function as well as a shielding function for wires.

The pipe may be provided with a plurality of the groove-like fitting members that are attached tightly to the circumference of a plurality of the wires.

According to the above configuration, the pipe can enwrap a plurality of wires.

The groove-like fitting member may form a cylindrical part enwrapping across the whole circumference of the wire.

According to the above configuration, the radiation efficiency is improved since the inner circumference of the cylindrical part is attached tightly across to the whole circumference of the wire.

The pipe may be formed by combining a plurality of plate shaped composing members having the groove-like fitting member.

According to the above configuration, the process for inserting wires into the pipe can be omitted.

An abutting member along a side edge of the plate shaped composing member may be formed in a plurality of the plate shaped composing members, so that, in a state that the groove-like fitting member is independently and externally fitted to the wire, the pipe is constituted by combining a plurality of the plate shaped composing member, with each corresponding abutting member rigidly fixed in a conductible manner.

According to the above configuration, the abutting members, that are spaced apart with the wire fitted to the groove-like fitting member, are brought closer and rigidly fixed each other, and the groove-like fitting member of the plate shaped composing member, in short, the inner circumferential surface of the pipe is therefore attached tightly and surely to the circumferential surface of the wire. This improves heat transfer efficiency from the circumference of the wire to the inner circumference of the pipe.

The plate shaped composing member may have a crooked shape, while the wire may comprise a conductor made of single core wires and be bent by bending work so as to have a shape following the plate shaped composing member.

The wire having a single core wire as a conductor is hard to be bent compared with the wire having a twisted wire as a conductor. Therefore, it is difficult to externally fit the groove-like fitting member to the wire, as bending the wire so as to follow the crooked shape of the plate shaped composing member.

According to the above configuration, the single core wire is bent by bending work so as to have a shape following the plate shaped composing member. Even when the plate shaped composing member has a crooked shape, this allows the groove-like fitting member to be easily and externally fitted to the wire having a conductor made of single core wires.

Each of the corresponding abutting members may be rigidly fixed to each other by seam welding.

According to the above configuration, when spot welding is used as means for combining the abutting members each other, the formation region of the magnetic closed circuit is limited to the welded part, however, in the present invention, the abutting members are combined to each other by seam welding, and thus, a magnetic closed circuit is formed across the entire length of the pipe, thereby delivering a high shielding performance.

A plurality of the groove-like fitting members are formed in each plate shaped composing member, and the portion positioned between the part between the groove-like fitting members next to each other in the plate shaped composing member and the part between the groove-like fitting members next to each other in the other plate shaped composing member may be in a magnetically-insulated condition. Additionally, a magnetically-insulated condition means a state where, for example, an area is provided or a non-magnetic substance is tucked between the part between the groove-like fitting members next to each other in the plate shaped composing member and the part between the groove-like fitting members next to each other in the other plate shaped composing member.

When, for example, three-phase current is applied to three wires in a state with a magnetic metal provided so as to individually enwrap the circumference of the three wires, a magnetic circuit is formed inside of each metal enwrapping the wires, and a looped magnetic flux therefore occurs in the circumferential direction of the wires. Then, hysteresis loss and eddy current loss increase, and thus, the metal generates heat. In case of a wire for electrical circuit in which a relatively large electrical current flows, the heating value becomes large, and accordingly, it is necessary to enlarge the cross-section area of the wire in order to reduce the heating value of the wire. Therefore, it now causes a problem of increased cost, since a non-magnetic substance needs to be used as a metal.

According to the above configuration, since the portion positioned between the part between the groove-like fitting members next to each other in the plate shaped composing member and the part between the groove-like fitting members next to each other in the other plate shaped composing member is in a magnetically-insulated condition, for example, a magnetic circuit collectively enwrapping three phases is formed on the whole. In this magnetic circuit, a combined value of balanced three-phase current is zero, and thus, the magnetic flux occurs due to this balanced three-phase current becomes also zero. As a result, using an expensive, non-magnetic substance for reducing hysteresis loss and eddy current loss is not needed, and an inexpensive ferromagnetic substance can therefore be used for cost reducing.

The cross-section shape of the wire may be a circular shape, and the pipe may be formed by combining two plate shaped composing members overlapped in the plate thickness direction, and so, the cross-section shape of the groove-like fitting member in each plate shaped composing member may be in a semicircular shape.

According to the above configuration, the pipe can be formed with the plate shaped composing members having an identical shape, and cost reduction can therefore be expected, compared with a case using metal plates having different shapes.

The cross-section shape of the wire may be nearly quadrilateral, and the cross-section shape of the groove-like fitting member in the each of the plate shaped composing members may be nearly quadrilateral. Additionally, the cross-section shape being nearly quadrilateral means the cross-section generally has an angle in its four corners, and that includes cases the angle is formed into an arc shape when viewed microscopically, or into a multiangular shape with each corner chamfered.

The nearly quadrilateral cross-section shape of the wire causes the surface area to be larger, compared with the wire of a circular cross section. This improves radiation performance of the wire. And the cross-section shape of the groove-like fitting member is also nearly quadrilateral like the wire, and thus, the radiation performance is improved, compared with a case the cross-section of the groove-like fitting member has a circular shape. This can improve radiation performance of the shield conductor on the whole.

Furthermore, the cross-section shape of the groove-like fitting member is nearly quadrilateral, and the circumference of the wire therefore receives pressing load also from the inner wall of the groove-like fitting member. This allows the circumference of the wire to be surely and tightly attached to the inner wall of the groove-like fitting member, and thereby improving the heat transfer efficiency from the circumference of the wire to the inner circumference of the pipe.

In addition, for example, when the plate shaped composing member is formed by press-molding, it is easier to reduce the drawing ratio compared with a case the cross-section shape of the groove-like fitting member is circular, and thereby allowing easy press molding.

The pipe may be formed by combining two plate shaped composing members overlapped in the plate thickness direction.

Since the pipe is formed by combining the overlapped two plate shaped composing members, attaching the pipe to the wire is easier, compared with a case where the wire is inserted into a cylindrically molded pipe.

The wire may have a cross-section of a flat and nearly rectangular shape, and may be arranged in a position with respect to the plate shaped composing member, so that the thickness direction of the wire and the plate thickness direction of the plate shaped composing member are in the same direction.

By arranging the thickness direction of the wire having a flat cross-section and the plate thickness direction of the plate shaped composing member in the same direction, the overall height of the shield conductor can be lowered in the thickness direction of the wire as well as the plate thickness direction of the plate shaped composing member.

The pipe may be formed by combining two plate shaped composing members overlapped in the plate thickness direction, and so, one plate shaped composing member may be a flat plate, while the other plate shaped composing member may be formed with the groove-like fitting member therein.

According to the above configuration, the groove-like fitting member may need to be formed only in one plate shaped composing member, and thus, a reduced manufacturing cost can be achieved.

The pipe may be formed with one plate shaped composing member folded back at almost the center.

According to the above configuration, the pipe can be formed from one metal plate material, and thereby achieving cost reduction.

DESCRIPTION OF SYMBOLS

Figure 1:
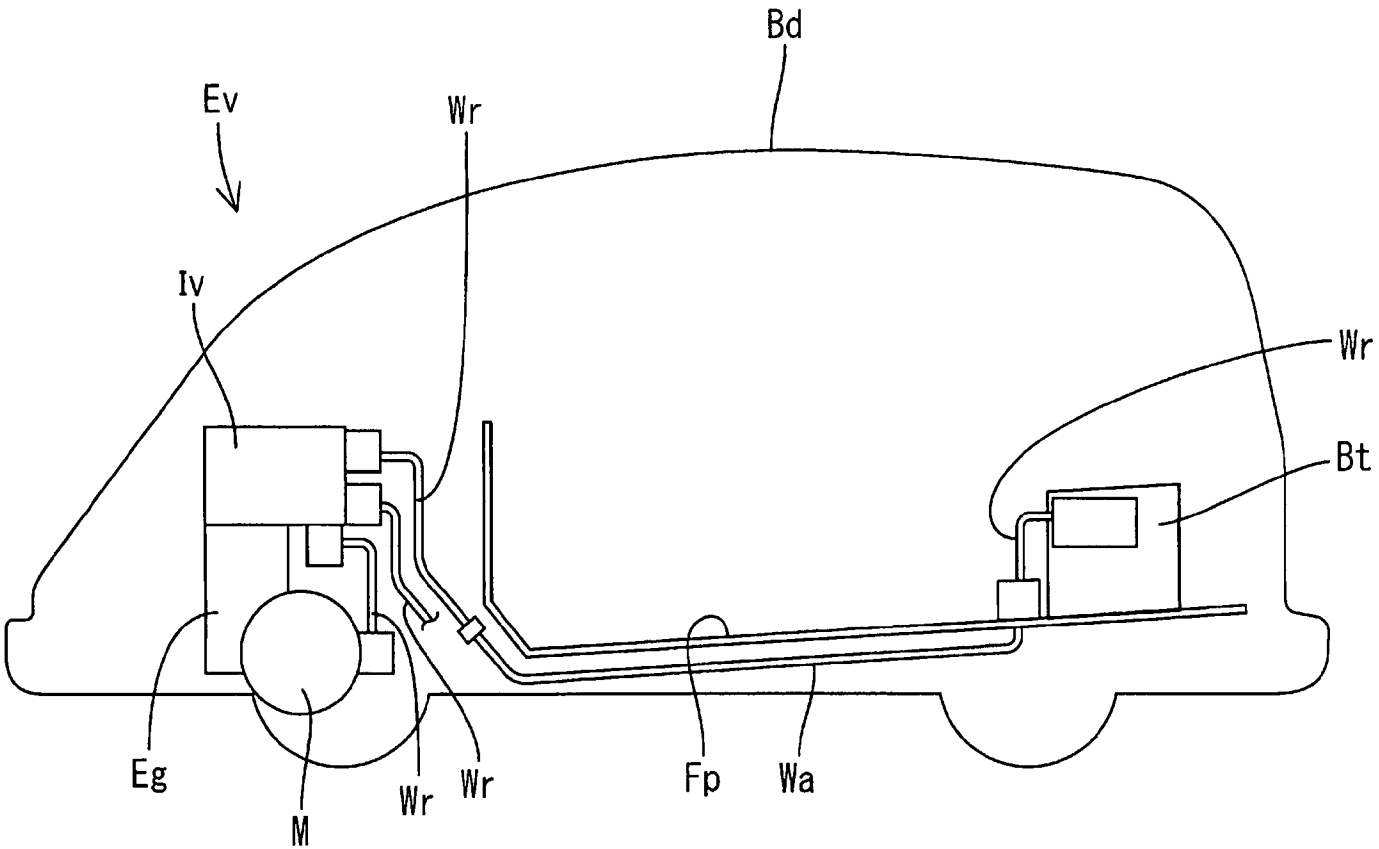
FIG. 1 is a pattern diagram showing a state where a shield conductor according to Embodiment 1 is mounted in an electric vehicle.
Figure 2:
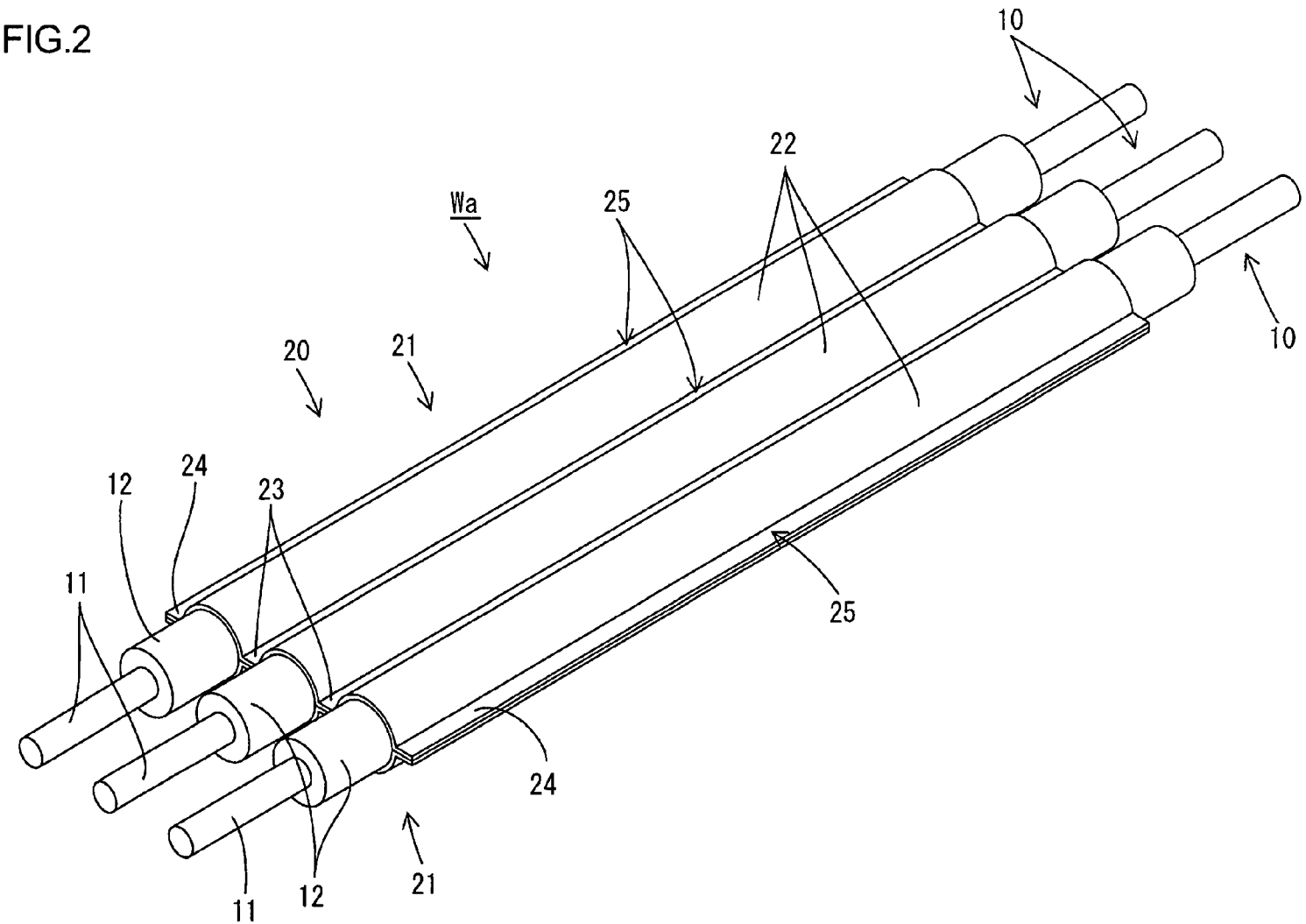
FIG. 2 is a perspective view of a shield conductor according to Embodiment 1.
Figure 3:
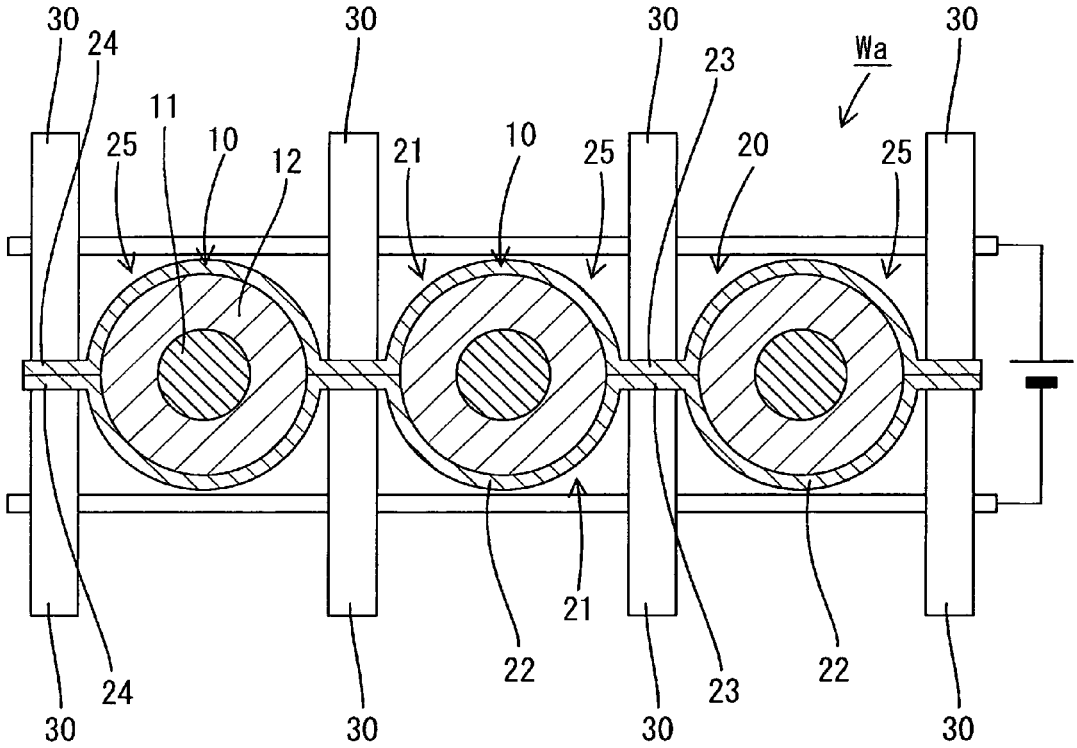
FIG. 3 is a cross-sectional view showing a shield conductor.
Figure 4:
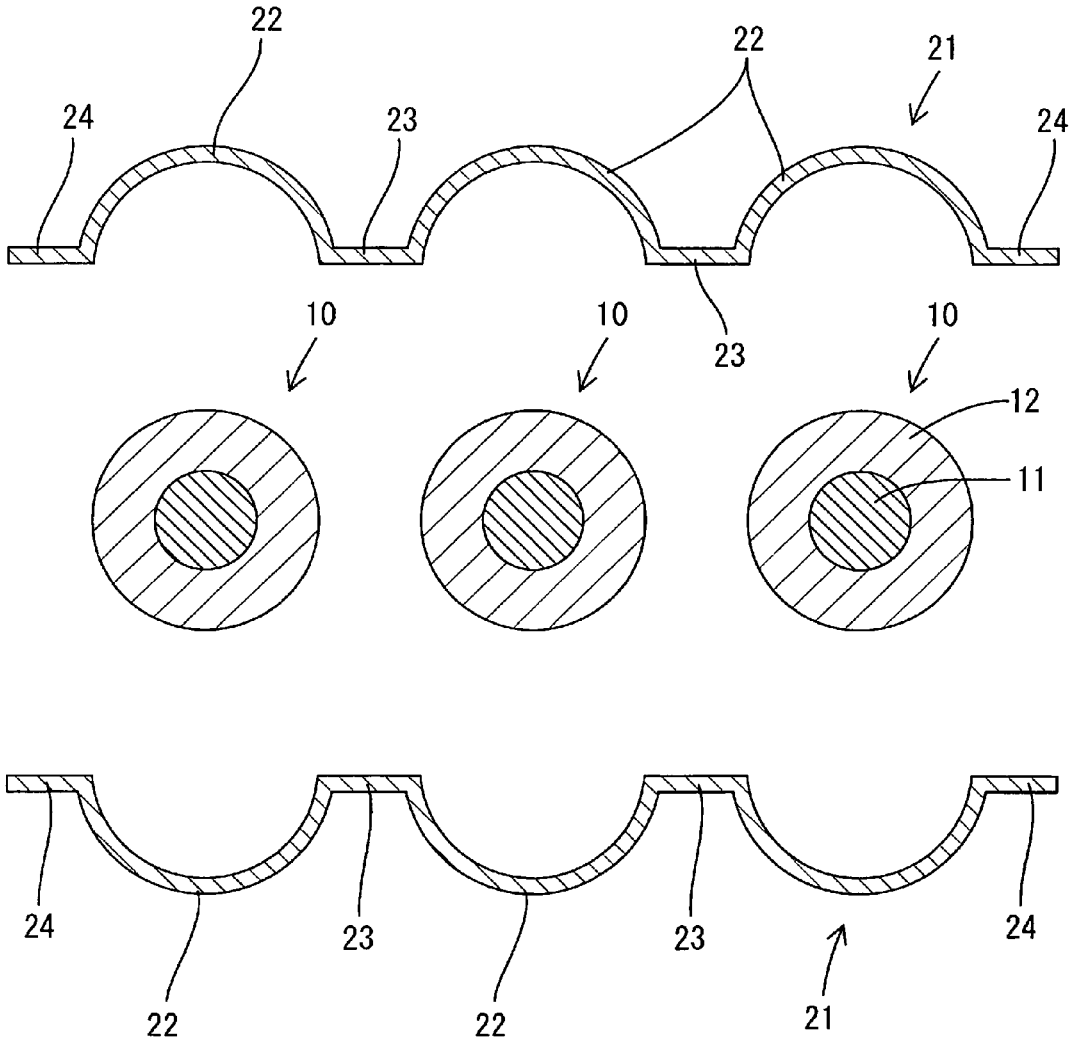
FIG. 4 is a cross-sectional view showing a separated state of wires and plate shaped composing members.
Figure 5:
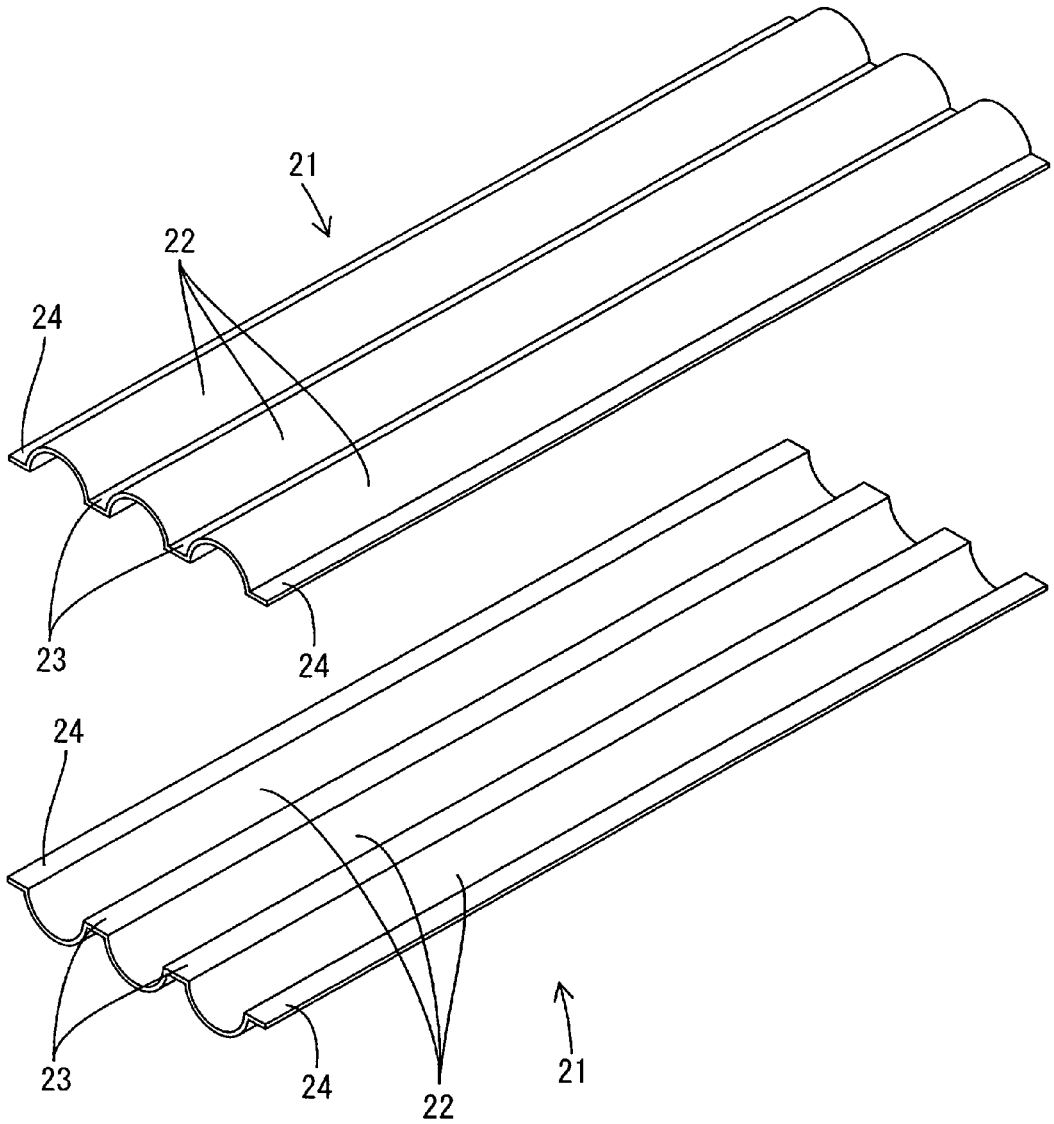
FIG. 5 is a perspective view showing a separated state of plate shaped composing members.

Wa, Wb, Wc, Wd, We, Wf, Wg, Wh, Wi, and Wj . . . Shield conductor

10, 90, and 110 . . . Wire

20, 40, 50, 60, 70, 80, and 120 . . . Pipe

21, 41, 51, 71, and 81 . . . Plate shaped composing member

22, 42, 53, 65, 66, 74, and 82 . . . groove-like fitting member

23, 54, 63, 75, 83, and 103 . . . Connecting part

24, 43, and 84 . . . Ear (abutting member)

25, 76, and 87 . . . Cylindrical part

122 . . . The upper plate shaped composing member (Plate shaped composing member)

123 . . . The lower plate shaped composing member (Plate shaped composing member)

Ev . . . Electric vehicle (vehicle)

Bd . . . Car body

BEST MODE FOR CARRYING OUT THE INVENTION

Embodiment 1

In what follows, as referring now to FIGS. 1 to 5, Embodiment 1 which materializes one aspect of the present invention, is described. A shield conductor Wa according to the present embodiment is, for example, placed between devices such as a battery Bt, an inverter Iv, and a motor M that compose a drive power source in an electric vehicle Ev (corresponding to a vehicle), and used for supplying an electric power for motive power. The shield conductor WA is constituted from a plurality of (three in the present embodiment) non-shielded wires 10 inserted into a pipe 20 having a collective shielding function as well as a wire protecting function. This shield conductor Wa is placed in the lower part of a floor plate Fp (under the floor) in a car body Bd of the electric vehicle Ev. The shield conductor Wa, the battery Bt, and the inverter Iv are connected through an in-car electrically-conducting path Wr. The gap between the inverter Iv and the motor M is also connected through the in-car electrically-conducting path Wr. In the present embodiment, the electric vehicle Ev comprises an engine Eg, however, may not comprise the engine Eg.

The wire 10 is formed by enwrapping the circumference of a metal conductor 11 (the metal is, for example, aluminum alloy and copper alloy) with an insulating coating 12 made from synthetic resin, and the conductor 11 is made of a twisted wire spirally twisting a plurality of thin wires (not shown). The cross-section shape of the conductor 11 and the insulating coating 12 are a perfect circular shape in that of the wire 10.

The pipe 20 is metallic, having higher heat conductivity than air. Three wires 10 in an aligned state in the right and left direction are inserted into the pipe 20, while both ends of the wire are guided to the outside of the pipe 20. The pipe 20 is constituted by combining a pair of upper and lower plate shaped composing members 21 molded by press-molding. In short, the pair of plate shaped composing members 21 are combined in a direction perpendicular to the aligning direction of the three wires 10. The pair of plate shaped composing members 21 have an identical shape, and are in the up-down reverse directions each other.

Each plate shaped composing member 21 has a cross-section; that is perpendicular to the axis line of the wire 10, in a semicircular arc shape and opening downwardly or upwardly, and is composed of: three groove-like fitting members 22 of a plate shape, arranged so as to align in the right and left direction, a plate-like and horizontal connecting part 23 connecting each of the side edges of these adjacent three groove-like fitting members 22, and a plate-like ear 24 (corresponding to an abutting member) horizontally protruding from the side edge in the outer side of the groove-like curved part positioned in the right and left end side of the plate shaped composing members 21. Any of these three groove-like fitting members 22, two connecting parts 23, and two ears 24 are continuously formed in a constant width across the entire length of the plate shaped composing member 21. In addition, the radius of the inner circumferential surface of the groove-like fitting member 22 is slightly smaller than that of the circumferential surface of the insulating coating 12 of the wire 10.

When manufacturing the shield conductor Wa, the lower half of the wire 10 is respectively fitted to three groove-like fitting members 22 in the plate shaped composing member 21 positioned in the lower side. This positions the three wires 10 with respect to the plate shaped composing member 21. In this state, when the upper plate shaped composing member 21 is overlapped onto the lower plate shaped composing member 21, three groove-like fitting members 22 in the upper plate shaped composing member 21 respectively and externally fit to the corresponding upper half of the wire 10, and at the same time, ears 24 and connecting parts 23 respectively face in a parallel and up and down manner each other. At this moment, a small clearance is formed between the upper connecting part 23 and the lower connecting part 23, so as between the upper ear 24 and the lower ear 24.

In this state, the spaced-apart upper and lower pair of connecting parts 23 and the ears 24 are tightly attached by being held between the upper and lower four pairs of roller 30, while at the same time, a voltage is applied between the upper rollers 30 and the lower rollers 30 so as to conduct seam welding. This allows each of the connecting parts 23 in a spaced-apart state to be tightly attached in a surface contact manner, and so as each of the ears 24 in a spaced-apart state. By conducting seam welding in both the right and left side of each wire 10 to each connecting part 23 and each ear 24 as mentioned above, a pair of the plate shaped composing members 21 are joined with the connecting parts 23 and the ears 24 combined, and thereby constituting the pipe 20.

In addition, with the connecting parts 23 and the ears 24 combined, the groove-like fitting members facing up and down direction constitutes a cylindrical part 25 having a circular cross section. Each cylindrical part 25 individually enwraps across the whole outer circumference of the wire 10, while at the same time, the inner circumferential surface of the cylindrical part 25 (the inner surface of the groove-like fitting member 22) is externally and rigidly attached across to the whole circumference of the insulating coating 12 of the wire 10. Additionally, the connecting part 23 intervenes between the adjacent cylindrical parts 25, and thus, the wires 10 next to each other do not contact each other inside of the pipe 20. According to the above, the shield conductor Wa is completed, with the three wires 10 and the pipe 20 integrated.

In a conventional shield conductor, since an air layer exists between a wire and a pipe, the heat generated at the time of energizing the wire is blocked by the air layer having a low heat conductivity, and is hardly transmitted to the pipe. Furthermore, since there exists no venting pathway to the outside, such as a clearance between knitted stitches in a braided wire, the heat generated in the wire is easily confined within the pipe, and the radiation performance therefore tends to degrade.

In response to this, the shield conductor Wa according to the present embodiment has a configuration in which the metal pipe 20 is mounted so as to be attached tightly across to the whole outer circumference of the three wires 10, and thus, the heat generated in the wire 10 is directly transmitted to the inner circumference of the pipe 20 from the circumference of the insulating coating 12, and then released to the air from the circumference of the pipe 20. Also, the ear 24 functions also as a heat radiation fin, thereby efficiently radiating heat therefrom too. According to the present embodiment, the heat releasing performance for the heat generated in the wire 10 is advanced, compared with the conventional art in which an air layer exists between the wire 10 and the pipe 20.

Additionally, in the present embodiment, each wire 10 is individually enwrapped by the cylindrical part 25, and thus, when the material for the pipe 20 is a ferromagnetic substance such as an iron plate and a steel plate, an electrical current flows in the cylindrical part 25 due to electromagnetic induction at the time of energizing the wire 10. Therefore, as a material for the pipe 20, nonmagnetic metals, such as a stainless steel, are preferred. For example, both the pair of plate shaped composing members 21 can be formed from a non-magnetic substance (such as Cu, Bs, and Al, or an alloy made from theses metals, or SUS). Also, one of a pair of the plate shaped composing members 21 may be a non-magnetic substance mentioned above, and the other may be a magnetic substance (such as a steel product). A magnetic substance in general is inexpensive compared to a non-magnetic substance, and thus, cost reduction can be expected by using a magnetic substance.

As an effect of improvement in radiation performance, weight reduction of the shield conductor Wa can be expected. In short, when a prescribed electrical current is applied to the wire 10 (the conductor 11), the smaller the cross-section area of the conductor 11 is, the greater the heating value of the wire 10 increases. However, according to the present embodiment which is superior in radiation performance, the temperature rise of the wire 10 can be restrained even when the heating value of the wire 10 is large. Therefore, under the environment where the upper limit of temperature rise of the wire 10 is determined like an electric vehicle, replacing the conventional shield conductor with the shield conductor Wa in the present embodiment that is superior in radiation performance enables the tolerance of heat generation of the wire 10 to increase relatively. And then, a relatively increased tolerance of heat generation of the wire 10 means it is possible to shrink the minimum and possible cross-section area of the conductor 11 under the environment where the upper limit of the temperature rise value of the wire 10 is determined, and the shield conductor Wa can therefore be more lightweight and downsized by shrinking the cross-section area of the conductor 11.

Also, according to the present embodiment, the groove-like fitting member 22 attached tightly to the circumference of the wire 10 is formed in the plate shaped composing member 21, so that the wire 10 can be positioned with respect to the plate shaped composing member 21. This improves the workability for combining the plate shaped composing members 21. Additionally, the pipe 20 is constituted by combining a pair of the plate shaped composing members 21, and thus, it is easier to fit the pipe 20 to the wire 10 in the present embodiment, compared with a configuration in which a wire is inserted into a pipe molded in a cylindrical shape.

Additionally, in the configuration in which the corresponding connecting parts 23 and the ears 24 each other are spaced apart up and down when a pair of plate shaped composing members 21 externally fitted to the wire 10, the pipe 20 is constituted by bringing each of these spaced-apart connecting parts 23 and ears 24 closer to each other and fixing them rigidly and conductibly. As the spaced-apart connecting parts 23 and the ears 24 are rigidly fixed each other, a pair of the plate shaped composing members 21 approach each other, while at the same time, the inner circumferential surfaces of the groove-like fitting members 22 in the pair of plate shaped composing members 21 are pressed tightly to the circumferential surface of the insulating coating 12 of the wire, so that the plate shaped composing member 21, in short, the inner circumferential surface of the pipe 20 is surely attached to the circumferential surface of the wire 10. This improves the heat transfer efficiency from the circumference of the wire 10 to the inner circumference of the pipe 20.

In addition, the inner circumference of the cylindrical part 25 (the pipe 20) is attached tightly across to the whole outer circumference of the wire 10, and this also improves radiation efficiency. Also, when spot welding is used as a combining means for the spaced-apart connecting parts 23 and the ears 24 each other, the formation region of the magnetic closed circuit is limited to the welded part. However, according to the present embodiment, the connecting parts 23 and the ears 24 are conductibly fixed to each other by seam welding, so that a magnetic closed circuit is formed across the entire length of the pipe 20. This achieves a high shielding performance.

Embodiment 2

Figure 6:
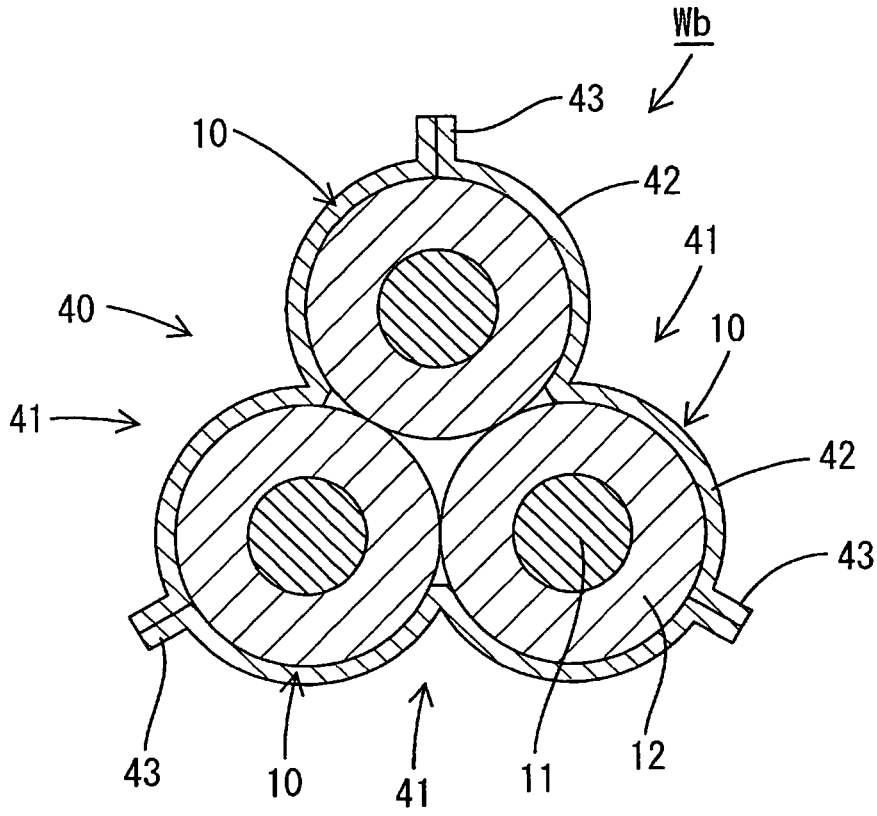
FIG. 6 is a cross-sectional view showing a shield conductor according to Embodiment 2.
Figure 7:
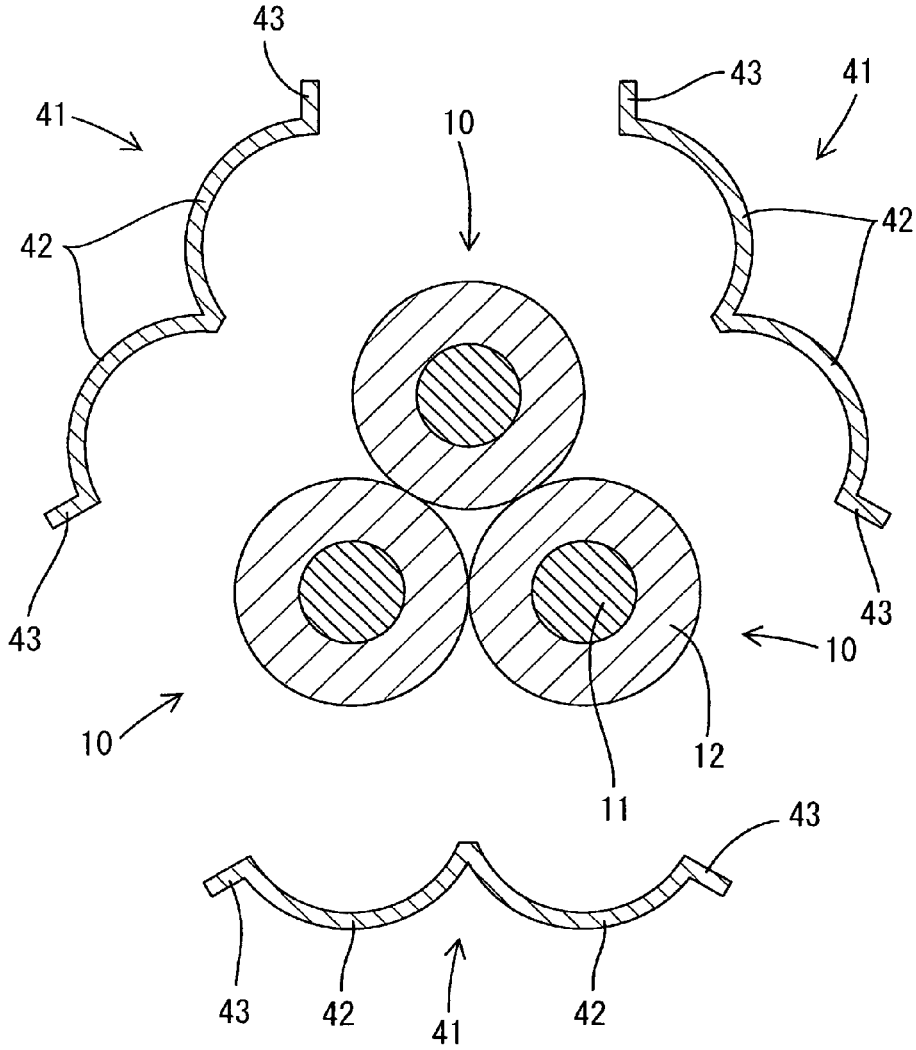
FIG. 7 is a cross-sectional view showing a separated state of wires and plate shaped composing members.

Next, as referring now to FIGS. 6 and 7, Embodiment 2 which materializes the present invention is described. In a shield conductor Wb according to the present Embodiment 2, the shape of a pipe 40 and the arrangement of the wire 10 inside of the pipe 40 are constituted differently from those in the above Embodiment 1. Since the other structures are the same as those in Embodiment 1, the same reference numbers are allotted to those of the corresponding structures, omitting descriptions on constitution, working, and effect.

The three wires 10 are arranged in positions attached tightly to each other, with their axis lines forming a right equilateral triangle. The pipe 40 is constituted by cylindrically combining three, press-molded plate shaped composing members 41. Three plate shaped composing members 41 may be formed from a non-magnetic substance (such as Cu, Bs, and Al, or an alloy made from theses metals, or SUS), or from a magnetic substance (such as iron plate or steel plate).

Three plate shaped composing members 41 have an identical shape, and are combined, facing directions different from each other. Each plate shaped composing member 41 has a cross-section, that is perpendicular to the axis line of the wire 10, in a circular arc shape, and is composed of two plate shaped groove-like fitting members 42 arranged so as to align close to each other and two plate shaped ears 43 (corresponding to an abutting member) protruding outwardly along both the edges of the plate shaped composing member 41. Any of two groove-like fitting members 42 and two ears 43 are formed continuously across the entire length of the plate shaped composing member 41 in a constant width. The groove-like fitting member 42 is to be externally fitted to one third (120° angle) of the circumference of the insulating coating of the wire 10, and the radius of the inner circumferential surface of the groove-like fitting member 42 is slightly smaller than that of the circumferential surface of the insulating coating of the wire 10.

When manufacturing the shield conductor Wb, two wires 10 are respectively fitted and positioned in two groove-like fitting members 42 in the plate shaped composing member 41 in a direction with the groove-like fitting member 42 opened upwardly, and moreover, the remaining one wire 10 is stacked on these two wires 10 fitted into the groove-like fitting members 42. This allows three wires 10 to be arranged in positions so that their axis lines form an equilateral triangle, and at the same time, be positioned with respect to the plate shaped composing member 41. In this state, the remaining two plate shaped composing members 41 cover these three wires 10 arranged in positions so that their axis lines form an equilateral triangle, and thereby externally fitting the groove-like fitting members 42 to these wires 10. In this state, a slight clearance is formed between the corresponding ears 43.

In this state, these spaced-apart ears 43 are respectively held between a pair of rollers (not shown) to be tightly attached each other, while at the same time, a voltage is applied between these rollers so that seam welding is performed like Embodiment 1. This rigidly fixes the spaced-apart ears 43 each other in a surface contact manner, and thus, three plate shaped composing members 41 are combined at the integrated ears 43, thereby constituting the pipe 40. The insulating coatings 12 of three wires 10 contact each other in the pipe 40, while an area of two thirds round of the circumference of each wire 10 are attached tightly to the inner circumferential surface of the pipe 40 (the groove-like fitting members 42). According to the above, three wires 10 and the pipe 40 are integrated so as to complete the shield conductor Wb.

Embodiment 3

Figure 8:
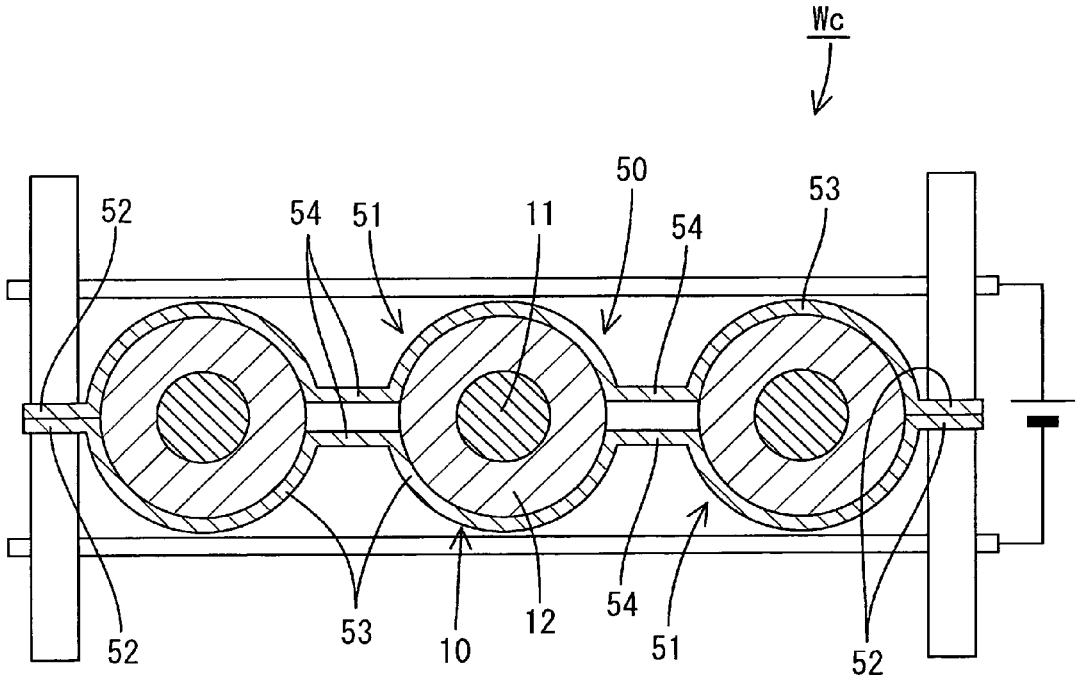
FIG. 8 is a cross-sectional view showing a shield conductor according to Embodiment 3.

Next, as referring now to FIG. 8, Embodiment 3 which materializes the present invention is described. In a shield conductor Wc according to the present Embodiment 3, the shape of a pipe 50 is constituted differently from that in the above Embodiment 1. Since the other structures are the same as those in Embodiment 1, the same reference numbers are allotted to those of the corresponding structures, omitting descriptions on constitution, working, and effect. The pipe 50 is constituted by combining a pair of vertically symmetrical plate shaped composing members 51, while two ears (corresponding to an abutting member) 52 and three groove-like fitting members 53 are formed in each plate shaped composing member 51. With three wires 10 held between the combined plate shaped composing members 51, the ears 52 are tightly attached each other so that this tightly attached part is rigidly and conductibly fixed by welding, however, the corresponding upper and lower connecting parts 54 each other do not contact.

When, for example, three-phase current is applied to three wires 10 in a state with a magnetic metal provided so as to individually enwrap the circumference of the three wires 10, a magnetic circuit is formed inside of each metal enwrapping the wires 10, and a looped magnetic flux therefore occurs in the circumferential direction of the wires 10. Then, hysteresis loss and eddy current increase, and thus, the metal generates heat. In case of the wire 10 for electrical circuit in which a relatively large electrical current flows, the heating value becomes large, and accordingly, it is necessary to enlarge the cross-section area of the wire 10 in order to reduce the heating value of the wire. Therefore, a problem of increased cost can occur, since a non-magnetic substance needs to be used as a metal.

To overcome the above problems, in the present embodiment, connecting parts 54 facing from both sides in a direction holding the wire 10 and positioned between three groove-like fitting members 53 are spaced apart each other, so as to be in a magnetically and electrically insulated condition. This forms a magnetic circuit collectively enwrapping the wires 10, in which three-phase current flows. In this magnetic circuit, a combined value of balanced three-phase current is zero, and thus, the magnetic flux occurs due to this balanced three-phase current becomes also zero. As a result, using an expensive, non-magnetic substance such as SUS as the plate shaped composing member 51 for reducing hysteresis loss and eddy current loss is not needed, and an inexpensive ferromagnetic substance such as a steel product can therefore be used for cost reducing.

Embodiment 4

Figure 9:
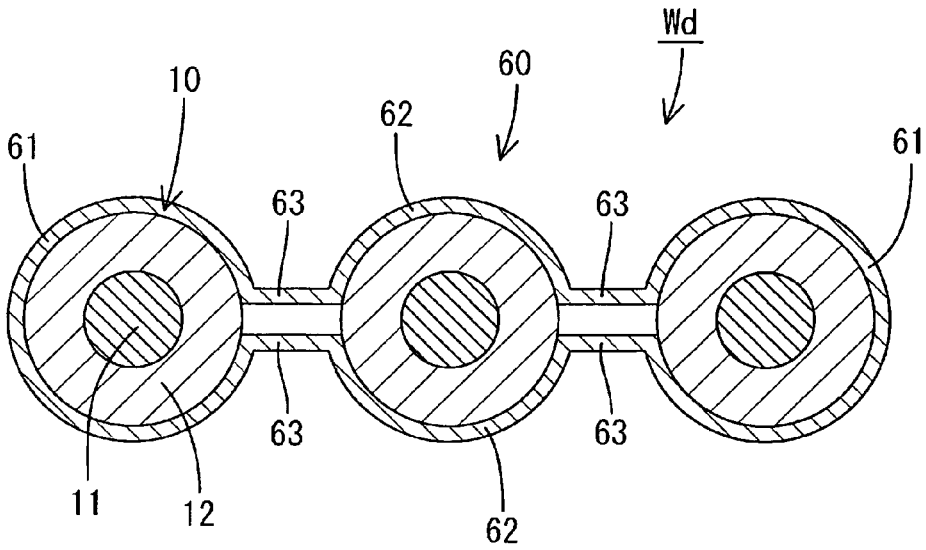
FIG. 9 is a cross-sectional view showing a shield conductor according to Embodiment 4.
Figure 10:
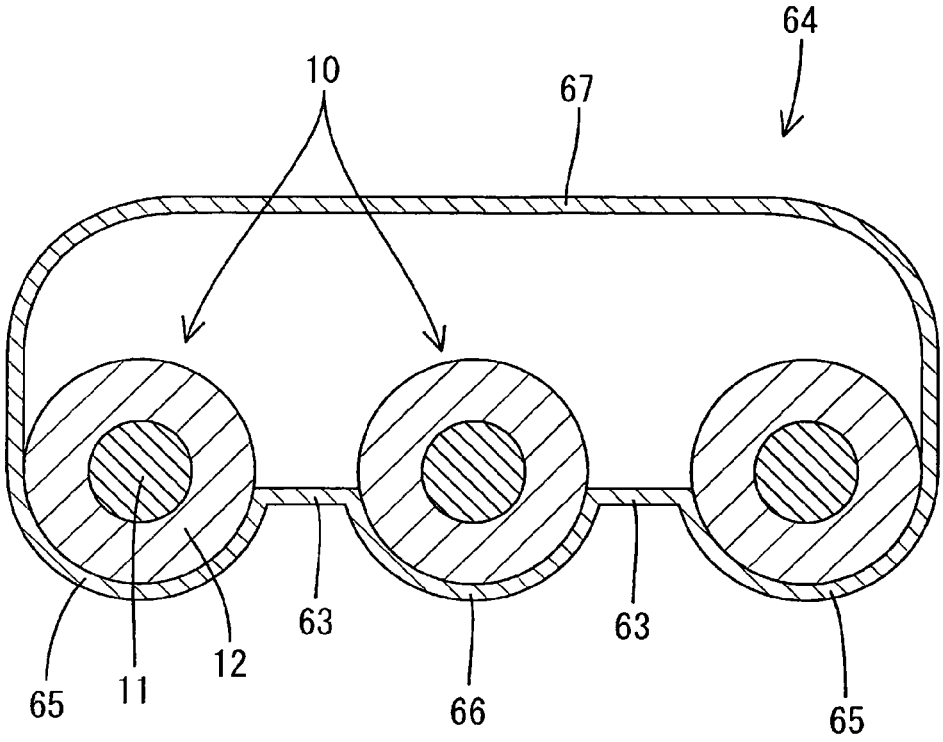
FIG. 10 is a cross-sectional view showing a state of a pipe before molding.

Next, as referring to FIGS. 9 and 10, Embodiment 4 which materializes the present invention is described. In a shield conductor Wd according to the present Embodiment 4, the shape of a pipe 60 is constituted differently from that in the above Embodiment 1. Since the other structures are the same as those in Embodiment 1, the same reference numbers are allotted to those of the corresponding structures, omitting descriptions on constitution, working, and effect.

The pipe 60 is a single part, composed of: a pair of bilaterally symmetrical arcuate parts 61 that are nearly C-shaped and separately enwrapping the wires 10 positioned at the both right and left ends, a pair of vertically symmetrical groove-like supporting parts 62 facing the upper surface side and the lower surface side of the wire 10 positioned in the center, and two pairs of connecting parts 63 in the right and left for connecting the arcuate parts 61 and the groove-like supporting parts 62. The arcuate part 61 is attached tightly to the area nearly the whole circumference of the wire 10, while each groove-like supporting part 62 is attached tightly to the area shorter than the half circumference of the wire 10. On the other hand, the connecting parts 63 are facing each other from up and down in a pair in parallel, however, such connecting parts 63 in a pair do not contact each other.

In addition, the pipe 60 is made by plastically deforming cylindrical member 64 as shown in FIG. 10. Formed in the lower surface of the cylindrical member 64 are: a pair of right and left groove-like fitting members 65 constituting a part of the arcuate part 61, a groove-like fitting member 66 as the lower groove-like supporting part 62, and a pair of right and left connecting parts 63 for connecting these groove-like fitting members 65 and 66 to each other. In addition, a nearly upper half area 67 (in short, the parts constituting the arcuate parts 61 in conjunction with the both right and left groove-like fitting members 65, the part to form the upper groove-like supporting part 62, and the part to form the upper connecting parts 63), other than these groove-like fitting members 65 and 66 and the connecting parts 63 in the lower side, is made to be spaced greatly and upwardly apart from the wire 10. When molding the pipe 60, the wires 10 are fitted and positioned in each of the groove-like fitting members 65 and 66, and then, the nearly upper half area 67 in the cylindrical member 64 is deformed so as to be attached tightly to the wires 10 by pressing. This forms the arcuate parts 61, the upper groove-like supporting part 62, and the upper connecting parts 63, so that the pipe 60 is molded in a prescribed shape, and at the same time, three wires 10 are held in a state collectively enwrapped by the pipe 60.

Embodiment 5

Figure 11:
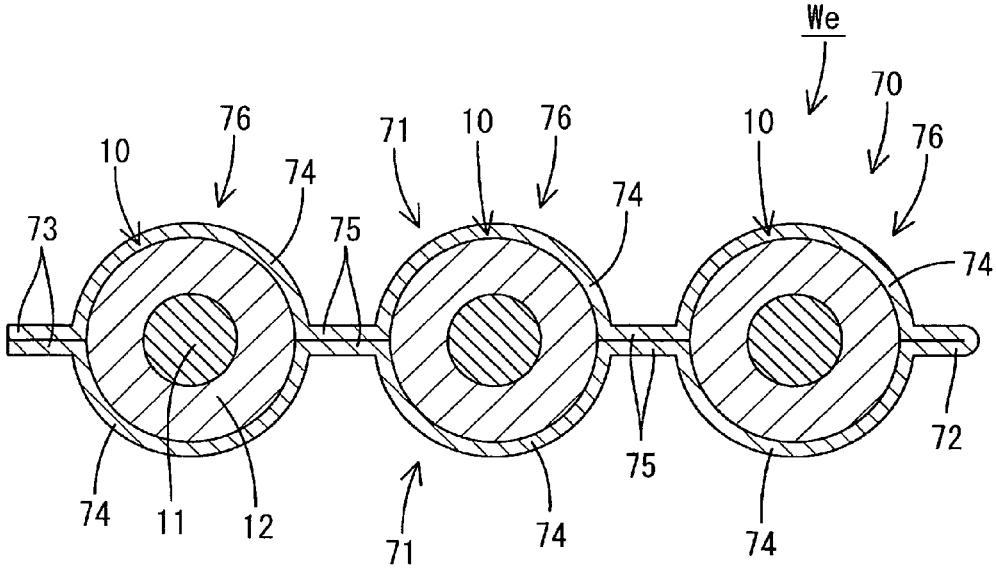
FIG. 11 is a cross-sectional view showing a shield conductor according to Embodiment 5.
Figure 12:
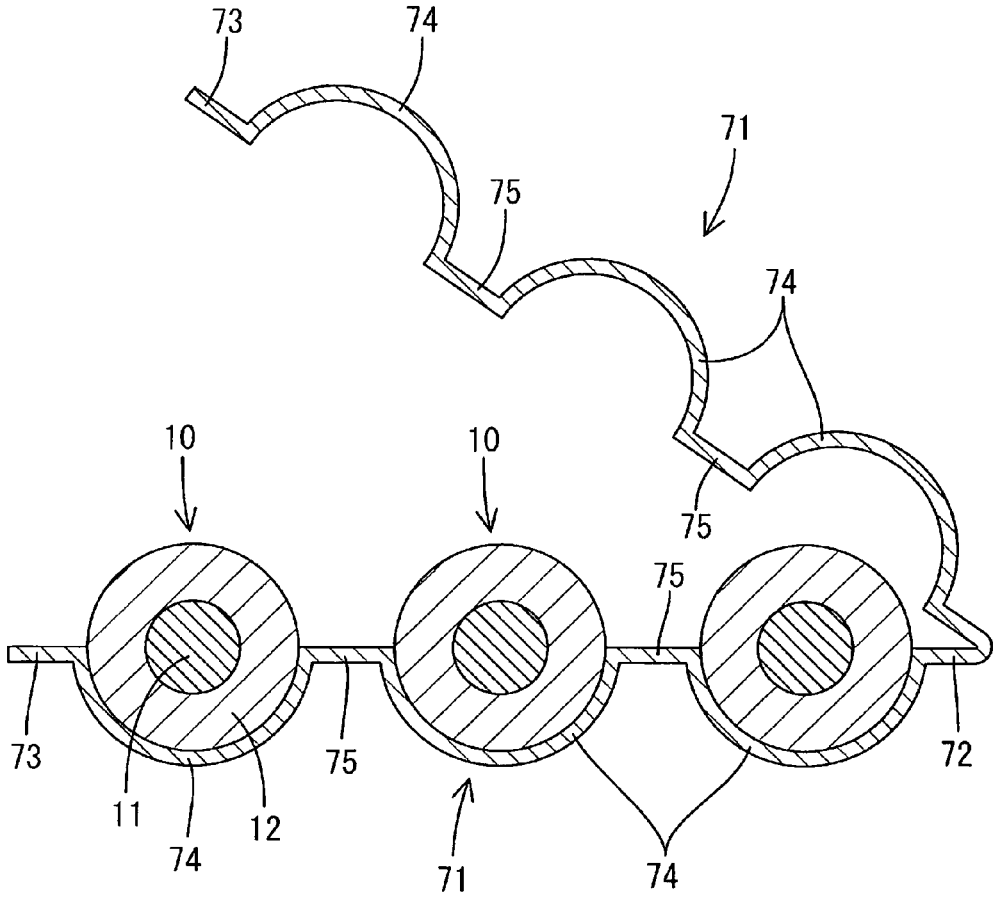
FIG. 12 is a cross-sectional view showing plate shaped composing members before being combined.
Figure 13:
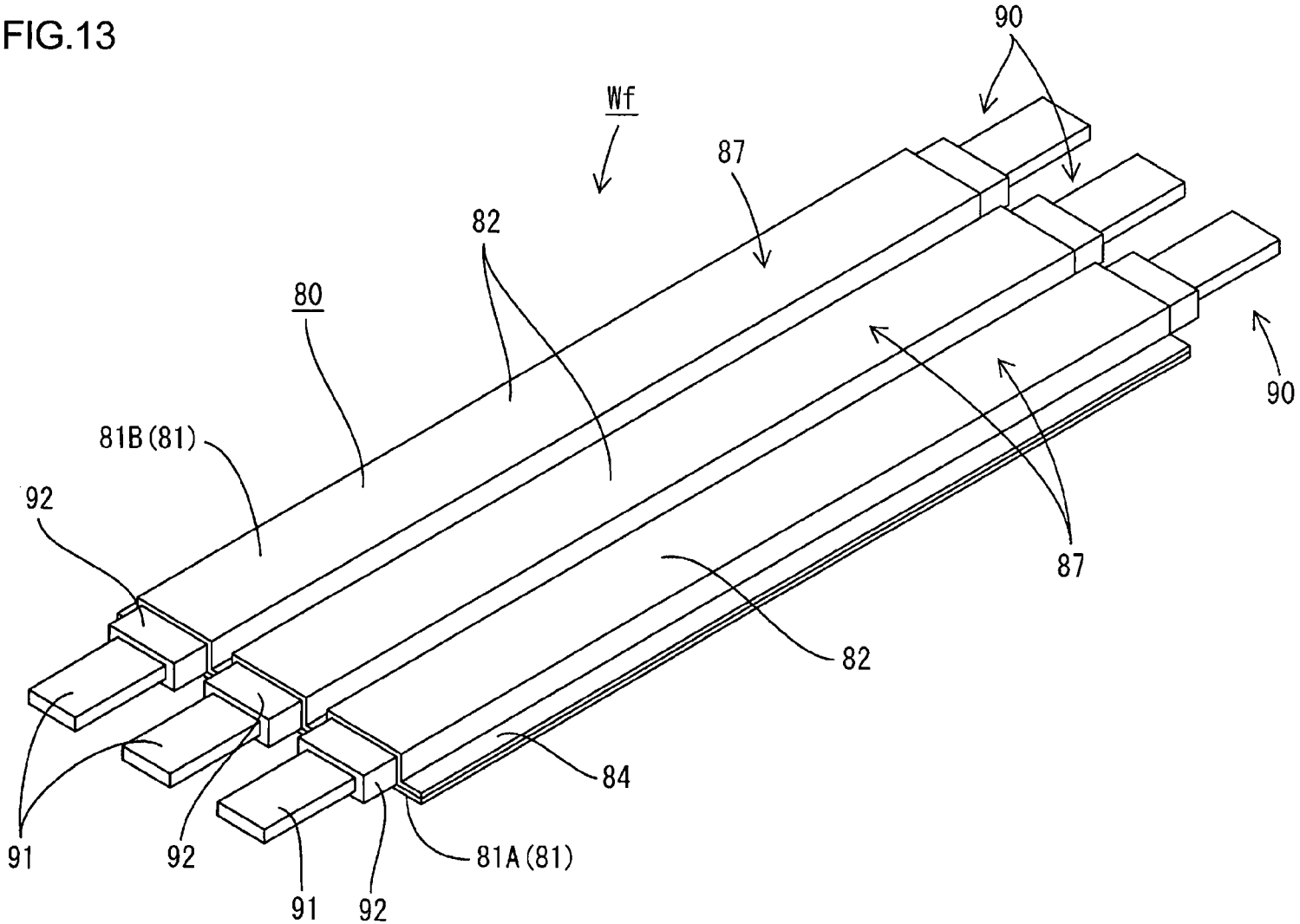
FIG. 13 is a perspective view of a shield conductor according to Embodiment 6.
Figure 14:
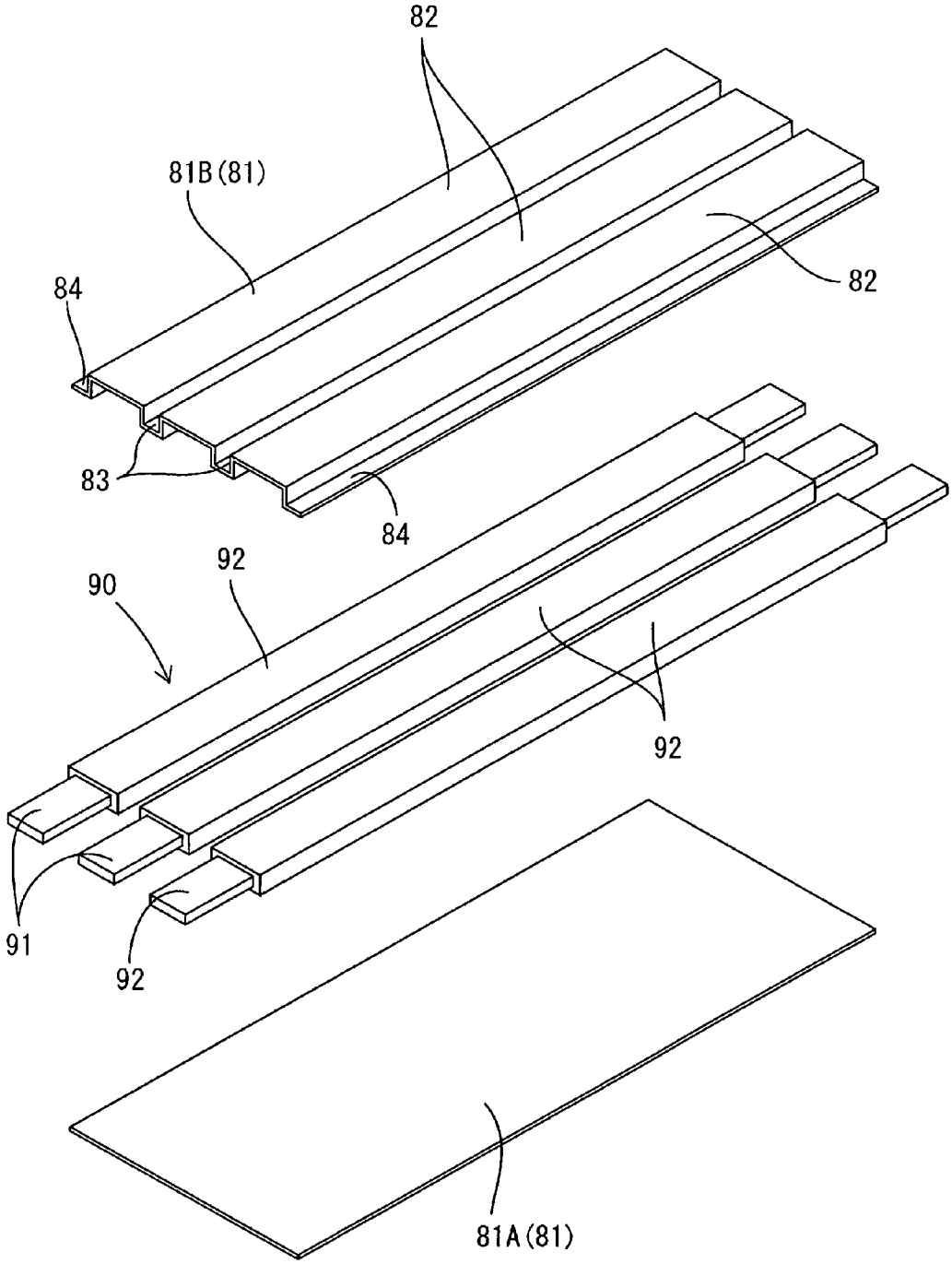
FIG. 14 is an exploded perspective view of a shield conductor.

Next, as referring to FIGS. 11 to 12, Embodiment 5 which materializes the present invention is described. In a shield conductor We according to the present Embodiment 5, the shape of a pipe 70 is constituted differently from that in the above Embodiment 1. Since the other structures are the same as those in Embodiment 1, the same reference numbers are allotted to those of the corresponding structures, omitting descriptions on constitution, working, and effect.

The pipe 70 is a single part as shown in FIG. 12, and constituted by combining a pair of vertically symmetrical plate shaped composing members 71 by a hinge 72, which nearly has a V shape and is formed in one end of the plate shaped composing members 71. Formed in each plate shaped composing member 71 are an ear (corresponding to an abutting member) 73 positioned in the opposite end from the hinge 72 and a pair of connecting parts 75 connecting each of three groove-like fitting members 74. This pair of plate shaped composing members 71 are combined with the hinge 72 as a support point (as deforming the hinge 72), and the upper and lower corresponding ears 73 each other and the upper and lower corresponding connecting parts 75 each other are conductibly and rigidly fixed by welding. This completes the pipe 70, and at the same time, forms cylindrical parts 76 that enwrap and are tightly attached to three wires 10 respectively across the whole circumference.

According to the present embodiment, the plate shaped composing member 71 as a single part can form the pipe 70, thereby achieving a reduced cost.

Embodiment 6

Next, as referring now to FIGS. 13 to 17, Embodiment 6 which materializes the present invention is described. In a shield conductor Wf according to the present Embodiment 6, the shape of a pipe 80 and a wire 90 are constituted differently from those in the above Embodiment 1. Since the other structures are the same as those in Embodiment 1, the same reference numbers are allotted to those of the corresponding structures, omitting descriptions on constitution, working, and effect.

Figure 15:
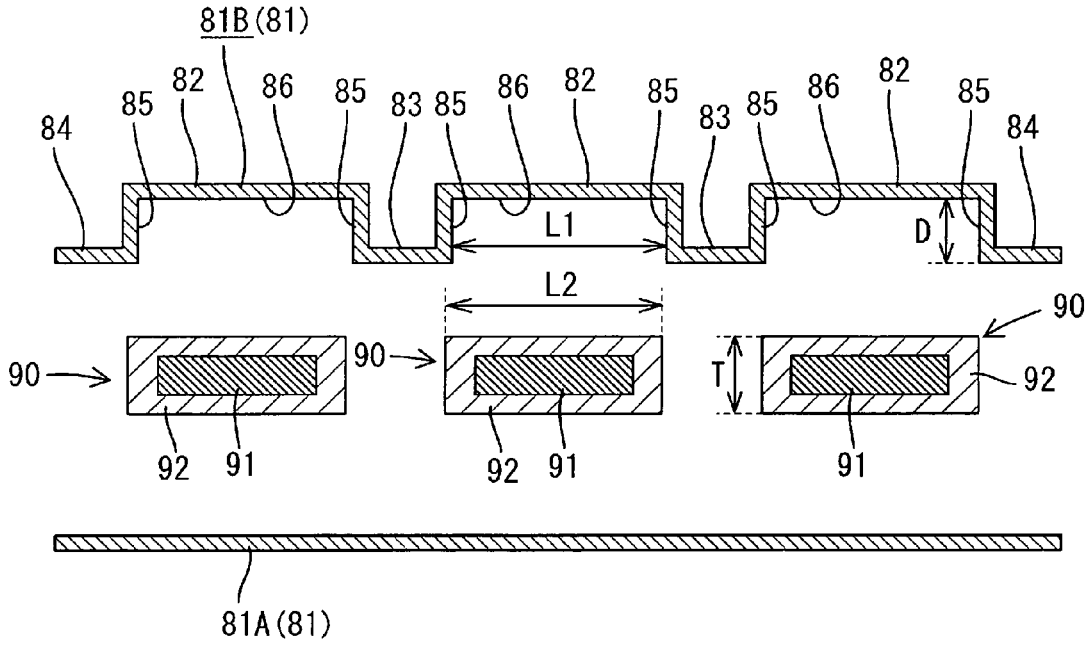
FIG. 15 is a cross-sectional view showing a separated state of wires and plate shaped composing members.
Figure 16:
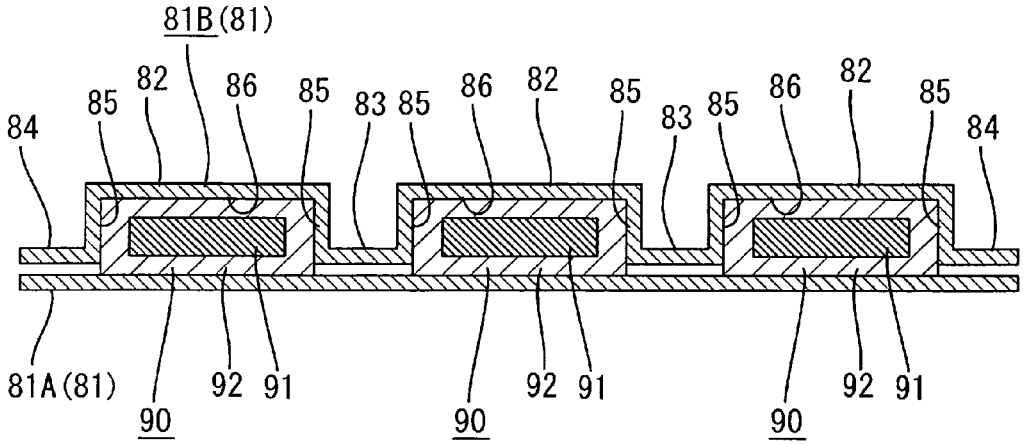
FIG. 16 is a cross-sectional view showing a state before seam welding of ears.

The wire 90 comprises a metal conductor 91, with its circumference enwrapped by an insulating coating 92 made from synthetic resin (see FIG. 15). The cross-section shape of the conductor 91 is flat and nearly quadrilateral (nearly rectangular). In addition, a nearly quadrilateral cross-section shape means the cross-section generally has an angle in its four corners, while a nearly rectangular cross-section shape means the cross-section shape generally forms a rectangular shape. And, that includes cases where an angle in a rectangle is formed into an arc shape when viewed microscopically, or into a multi-angular shape with each corner chamfered.

The insulating coating 92 in a prescribed thickness is enwrapping the circumference of the conductor 91. Therefore, the cross-section shape of the wire 90 becomes flat and nearly quadrilateral (nearly rectangular), following that of the conductor 91.

Figure 17:
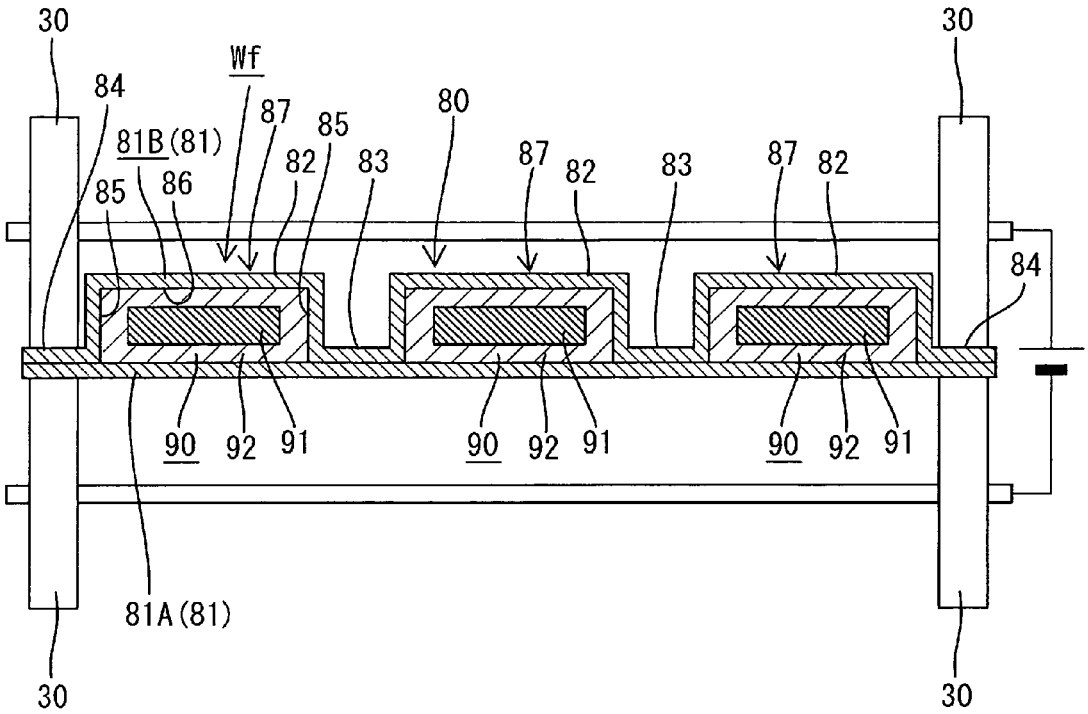
FIG. 17 is a cross-sectional view showing a shield conductor.

As shown in FIG. 17, the pipe 80 is constituted by combining a pair of plate shaped composing members 81. Arranged in the lower side in FIG. 17 is a first plate shaped composing member (corresponding to one plate shaped composing member) 81A which is a flat plate, while in the upper side is a second plate shaped composing member (corresponding to the other plate shaped composing member) 81B.

Both of a pair of plate shaped composing members 81 may be formed from a non-magnetic substance (such as Cu, Bs, and Al, or an alloy made from theses metals, or SUS). Also, one of a pair of the plate shaped composing members 81 may be a non-magnetic substance mentioned above, and the other may be a magnetic substance (such as a steel product). A non-magnetic substance in general is expensive compared to a magnetic substance, and thus, cost reduction can be expected by using a magnetic substance.

The second plate shaped composing member 81B is formed by press-molding. The second plate shaped composing member 81B has a cross-section, that is perpendicular to the axis line of the wire 90, in a nearly quadrilateral shape (nearly rectangular shape) and opening downwardly in FIG. 17, and is composed of: three groove-like fitting members 82 arranged so as to align in the right and left direction, a plate-like and horizontal connecting part 83 connecting each of the side edges of these corresponding (adjacent) three groove-like fitting members 82, and a plate-like ear 84 (corresponding to an abutting member) horizontally protruding from the side edge in the outer side of the groove-like fitting member 82 positioned in the right and left ends. Any of these three groove-like fitting members 82, two connecting parts 83, and two ears 84 are continuously formed in a constant width across the entire length of the second plate shaped composing member 81B.

A spacing L1 (a spacing in the right and left direction in FIG. 15) between each of a pair of inner walls 85 opposing in the groove-like fitting member 82 is slightly smaller than a width L2 of the wire 90 in the right and left direction in FIG. 15.

In addition, a depth D of the groove-like fitting member 82 (a vertical size in FIG. 15 from the lower surface of the ear 84 to the inner surface of the upper wall 86 of the groove-like fitting member 82) is smaller than a thickness T of the wire 90 in the vertical direction in FIG. 15.

The shield conductor Wf is manufactured as below. First of all, the wires 90 are respectively fitted in three groove-like fitting members 82 in the second plate shaped composing member 81B, in a posture with the thickness direction of the wire 90 (the vertical direction in FIG. 15) facing the plate thickness direction of the second plate shaped composing member 81B (the vertical direction in FIG. 15). This allows three wires 90 to be positioned with respect to the second plate shaped composing member 81B. In this state, the second plate shaped composing member 81B and the first plate shaped composing member 81A are overlapped in the plate thickness direction of both the plate shaped composing members 81A and 81B (the vertical direction in FIG. 16). Here, a slight clearance is formed between the connecting part 83 in the second plate shaped composing member 81B and the first plate shaped composing member 81A, and so as between the ear 84 in the second plate shaped composing member 81B and the first plate shaped composing member 81A.

In this state, as shown in FIG. 17, the spaced-apart ear 84 and the first plate shaped composing member 81A are tightly attached to each other by being held between a pair of the upper and the lower rollers 30, while at the same time, a voltage is applied between the upper roller 30 and the lower roller 30 so as to conduct seam welding. According to this, the ear 84 and the first plate shaped composing member 81A in a spaced-apart state are rigidly fixed to a tightly attached state in a surface contact manner. By conducting seam welding between the ear 84 and the first plate shaped composing member 81A, a pair of the plate shaped composing members 81A and 81B are joined with the ears 84 being combined, and thereby constituting the pipe 80. In this moment, the connecting part 83 and the first plate shaped composing member 81A contact each other.

In addition, the rigidly fixed ear 84 and first plate shaped composing member 81A allow the groove-like fitting members 82 and the first plate shaped composing member 81A to constitute cylindrical parts 87 having a nearly quadrilateral (nearly rectangular) cross-section. Each cylindrical part 87 enwraps the wire 90 individually across the whole circumference, and at the same time, the inner circumferential surface of the cylindrical part 87 (the inner surface of the groove-like fitting member 82) is tightly attached to the circumferential surface of the insulating coating 92 of the wire 90 across the whole circumference. According to the above, the shield conductor Wf is completed, with the three wires 90 and the pipe 80 integrated.

In what follows, the working and effect of the present embodiment is described. In the present embodiment, the cross-section shape of the wire 90 is nearly quadrilateral (nearly rectangular), and thereby having an enlarged surface area compared with a wire having a circular cross section. This improves radiation performance of the wire 90. And the cross-section shape of the groove-like fitting member 82 is also nearly quadrilateral (nearly rectangular) like the wire, and thus, radiation performance is improved compared with a case the cross-section of the groove-like fitting member 82 has a circular shape. This can improve radiation performance of the shield conductor Wf on the whole.

Furthermore, the cross-section shape of the groove-like fitting member 82 is nearly quadrilateral (nearly rectangular), and the circumference of the wire 90 therefore receives a pressing load also from the inner wall of the groove-like fitting member 82. This allows the circumference of the wire 90 to be surely and tightly attached to the inner wall 85 of the groove-like fitting member 82, and thereby improving the heat transfer efficiency from the circumference of the wire 90 to the inner circumference of the pipe 80.

In addition, when the second plate shaped composing member 81B is formed by press-molding like the present embodiment, it is easier to reduce the drawing ratio compared with a case of the groove-like fitting member 82 having a circular cross-section shape, and thereby allows easy press molding.

Since the pipe 80 is formed by combining the overlapped first plate shaped composing member 81A and the second plate shaped composing member 81B in the present embodiment, attaching the pipe 80 to the wire 90 is easier, compared with a case where the wire 90 is inserted into a cylindrically molded pipe 80.

Additionally, in the configuration in which the corresponding connecting part 83 and the first plate shaped composing member 81A are spaced apart up and down when a pair of plate shaped composing members 81A and 81B externally fitted to the wire 90, the pipe 80 is constituted by bringing each of the spaced-apart connecting parts 83 and the first plate shaped composing member 81A closer to each other and fixing them rigidly and conductibly. As the spaced-apart connecting part 83 and the first plate shaped composing member 81A are rigidly fixed each other, a pair of the plate shaped composing members 81A and 81B approach each other, while at the same time, the inner circumferential surfaces of the groove-like fitting members 82 in the pair of plate shaped composing members 81A and 81B are pressed tightly to the circumferential surface of the insulating coating 92 of the wire 90 from the vertical directions (the plate thickness direction of the pair of plate shaped composing members 81A and 81B), so that the plate shaped composing members 81A and 81B, in short, the inner circumferential surface of the pipe 90 is surely attached to the circumferential surface of the wire 90. This improves the heat transfer efficiency from the circumference of the wire 90 to the inner circumference of the pipe 80.

Additionally, by arranging the thickness direction of the wire 90 in the same direction as the plate thickness direction of both the plate shaped composing members 81A and 81B, the height of the shield conductor Wf can be lowered on the whole in the thickness direction of the wire 90 as well as the plate thickness direction of the plate shaped composing members 81A and 81B.

Also, the first plate shaped composing member 81A is a flat plate, and is therefore excellent for adhesion with the wire 90. This can improve radiation performance of the shield conductor Wf.

Embodiment 7

Figure 18:
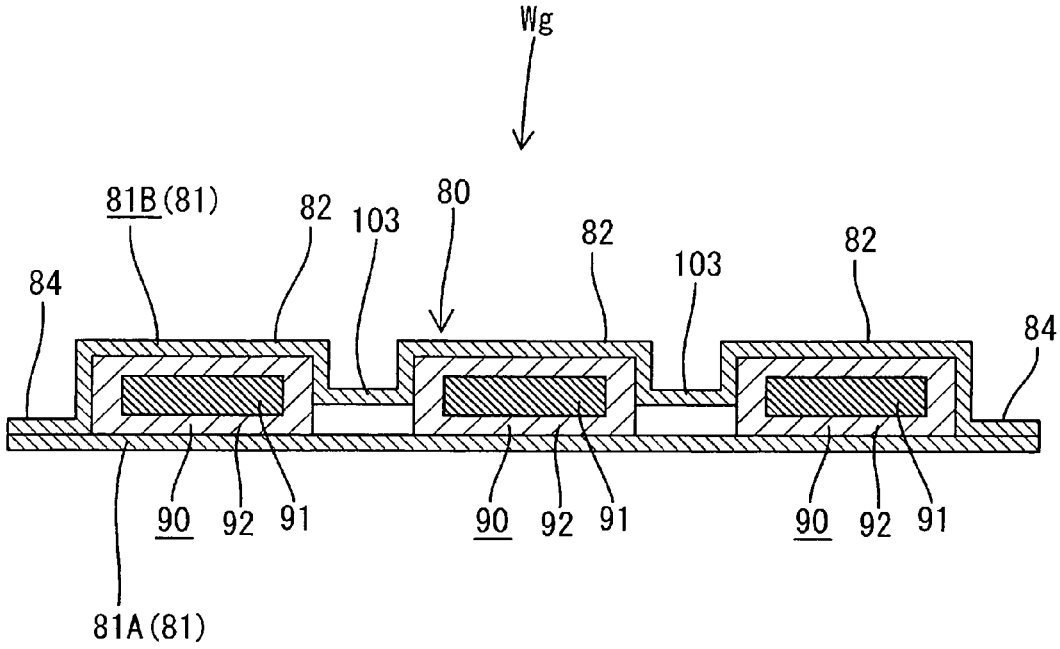
FIG. 18 is a cross-sectional view showing a shield conductor according to Embodiment 7.

Next, as referring to FIG. 18, Embodiment 7 which materializes the present invention is described. In a shield conductor Wg according to the present embodiment, a connecting part 103 in the second plate shaped composing member 81B and the first plate shaped composing member 81A do not contact each other. Since the other structures are the same as those in Embodiment 6, the same reference numbers are allotted to those of the corresponding structures, omitting descriptions on constitution, working, and effect.

According to the present embodiment, the connecting part 103 in the second plate shaped composing member 81B and the first plate shaped composing member 81A do not contact each other. This forms a magnetic circuit collectively enwrapping the wires 90, in which three-phase current flows. In this magnetic circuit, a combined value of balanced three-phase current is zero, and thus, the magnetic flux occurs due to this balanced three-phase current becomes also zero. As a result, using an expensive, non-magnetic substance such as SUS as the plate shaped composing member 81A and 81B for reducing hysteresis loss and eddy current loss is not needed, and an inexpensive ferromagnetic substance such as a steel product can therefore be used for cost reducing.

Embodiment 8

Figure 19:
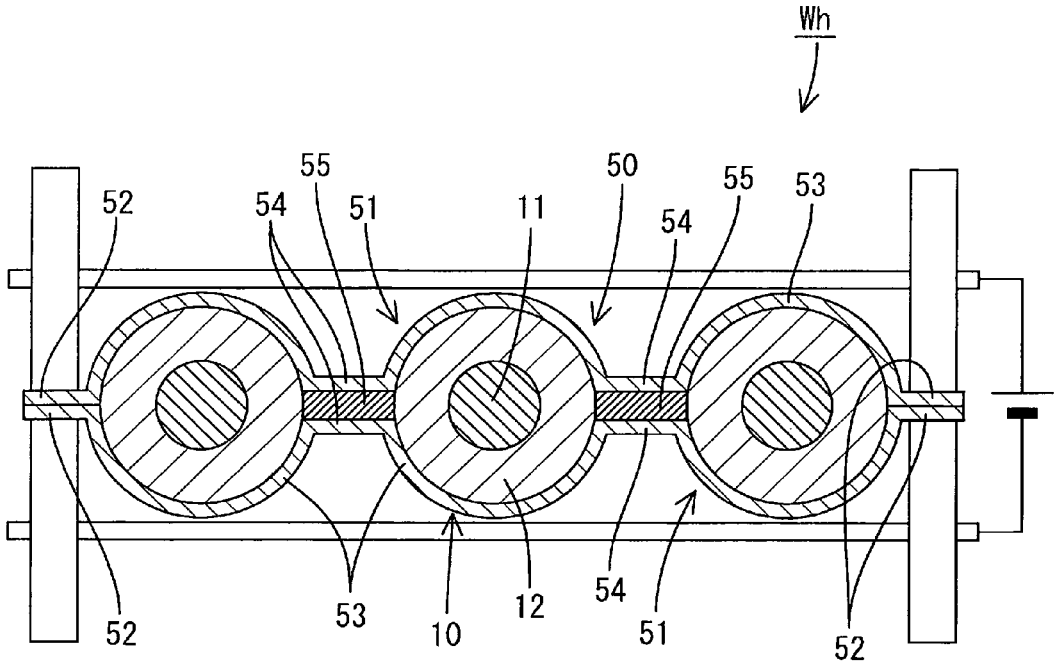
FIG. 19 is a cross-sectional view showing a shield conductor according to Embodiment 8.

Next, as referring now to FIG. 19, Embodiment 8 which materializes the present invention is described. In a shield conductor Wh according to the present embodiment, connecting parts 54 positioned between three groove-like fitting members 53 and opposing each other from the both sides across the wire 10 are spaced apart, and have a non-magnetic substance 55 provided there between. The non-magnetic substance 55 is held between and attached to the connecting parts 54 from the vertical direction in FIG. 19. According to this, the connecting parts 54 each other are in a magnetically and electrically insulated condition. Since the other structures are the same as those in Embodiment 3, the same reference numbers are allotted to those of the corresponding structures, omitting descriptions on constitution, working, and effect.

Air has a relatively low heat conductivity, and when an air layer is formed between the opposing connecting parts 54, heat is therefore confined in this air layer, and temperature rise in the wire 10 may be concerned.

To overcome the above problems, the non-magnetic substance 55 is held between the opposing connecting parts 54 in the present embodiment. This prevents heat from being confined between the connecting parts 54.

As the non-magnetic substance 55, any non-magnetic substances such as, for example, SUS, synthetic resin, or Cu, Bs, Al, or an alloy made from theses metals may be used. Among these, metals such as copper and SUS are preferred since having high heat conductivity.

Embodiment 9

Next, as referring now to FIGS. 20 to 29, Embodiment 9 which materializes the present invention is described. In a shield conductor Wi according to the present embodiment, a pipe 120 and a wire 110 are constituted differently from those in the above Embodiment 3. Since the structures other than the above are the same as those in Embodiment 3, the same reference numbers are allotted to those of the corresponding structures, omitting descriptions on constitution, working, and effect.

Figure 20:
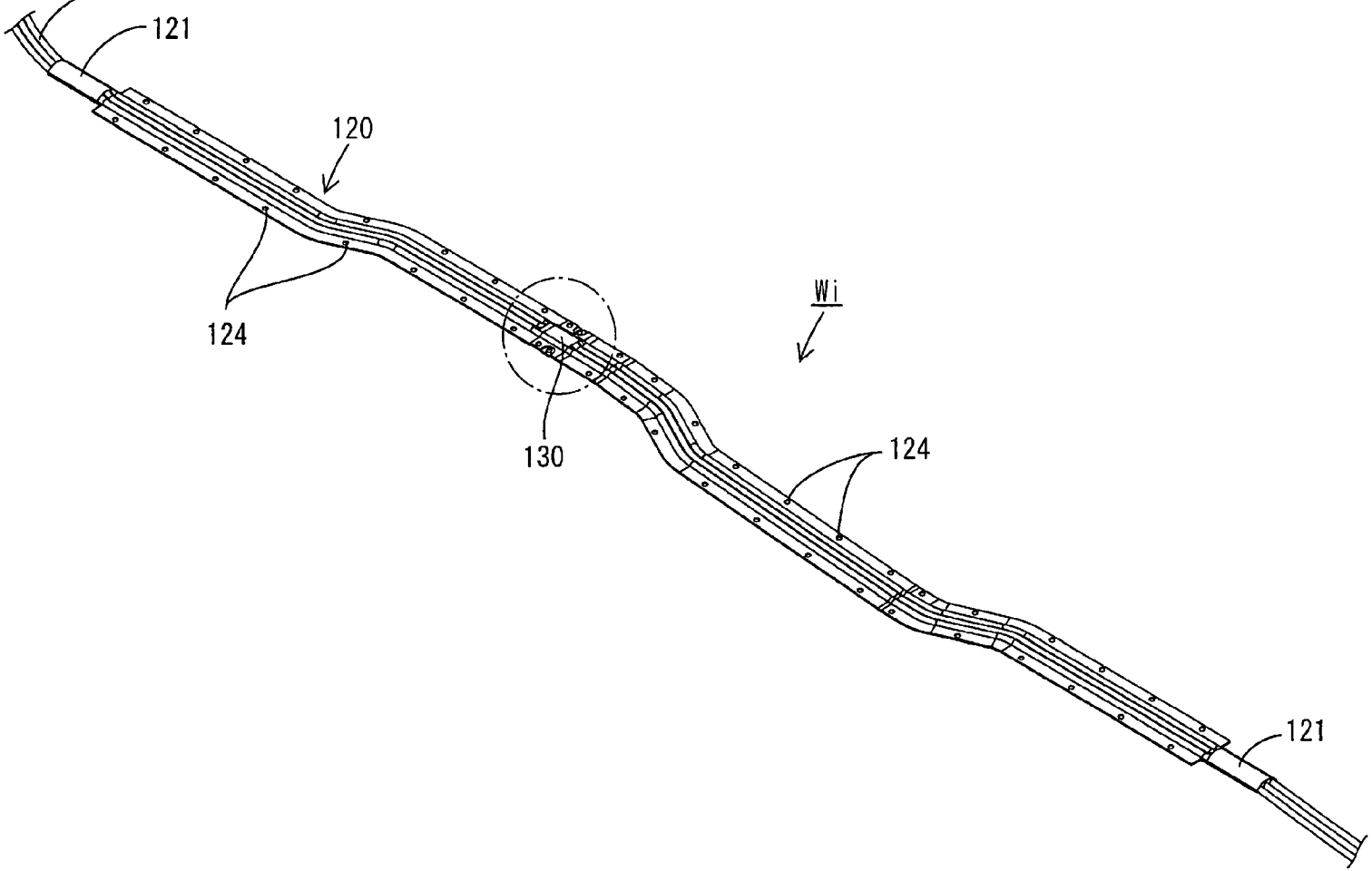
FIG. 20 is a perspective view of a shield conductor according to Embodiment 9.
Figure 22:
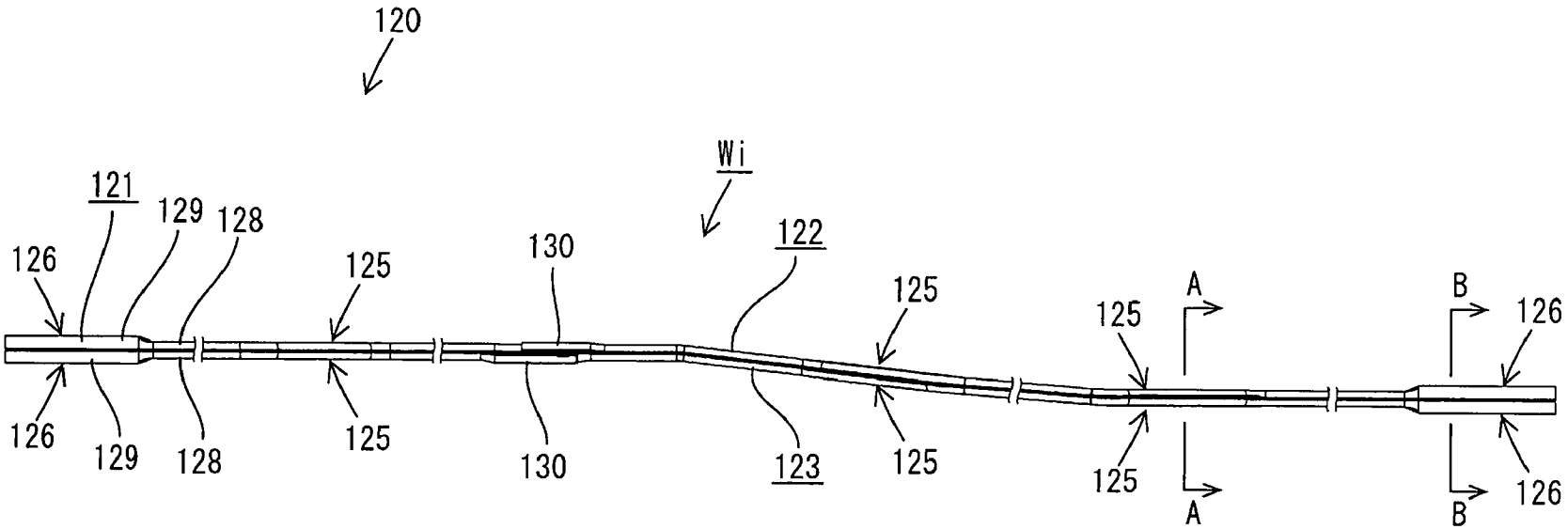
FIG. 22 is a side view showing a shield conductor.
Figure 24:
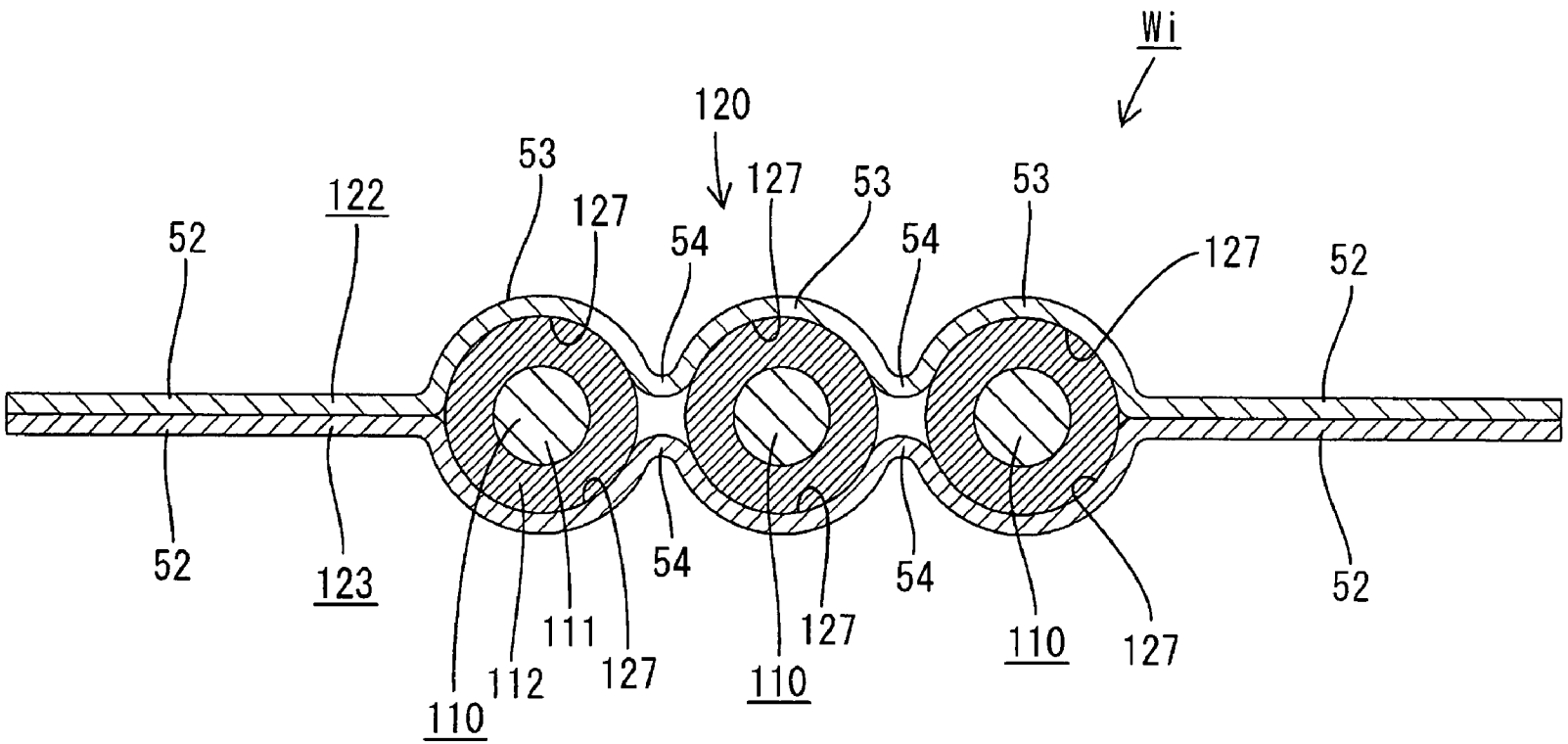
FIG. 24 is a cross-sectional view taken along a line A-A in FIG. 22.

As shown in FIGS. 20 and 22, the pipe 120 has a crooked shape. The pipe 120 is formed in a shape so as to follow the underfloor of the car body Bd. As shown in FIG. 20, the pipe 120 is crooked so as to snake through in its extending direction, and at the same time, is also crooked vertically in FIG. 22. A plurality of (three in the present embodiment) the wires 110 are inserted into the pipe 120 as shown in FIG. 24.

Figure 25:
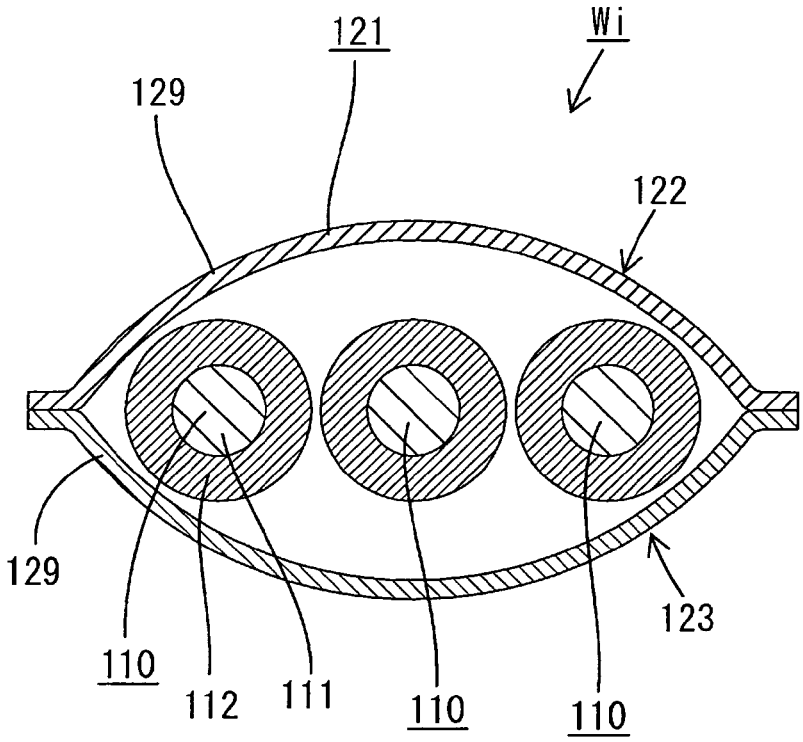
FIG. 25 is a cross-sectional view taken along a line B-B in FIG. 22.

And also, as shown in FIG. 20, cylindrical connecting parts 121 are provided in both ends of the pipe 120 for connecting with a braided wire not shown. Three wires 110 are inserted into the connecting part 121 as shown in FIG. 25. As shown in FIG. 20, the wires 110 are extended outwardly from the end of the connecting part 121.

The pipe 120 is constituted by combining the upper plate shaped composing member (corresponding to a plate shaped composing member) 122 positioned in the upper side in FIG. 22 and the lower plate shaped composing member (corresponding to a plate shaped composing member) 123 positioned in the lower side in the same figure. Two ears 52 (corresponding to an abutting member) and three groove-like fitting members 53 are formed in each of the plate shaped composing members 122 and 123. With three wires 110 held between the combined plate shaped composing members 122 and 123, the ears 52 each other are connected by so-called TOX (registered trademark) caulking. In caulked parts 124 that have been TOX caulked, both the plate shaped composing members 122 and 123 are conductible each other. The caulked parts 124 are formed in the ear 52 as aligned in the extending direction of both the plate shaped composing members 122 and 123 with a spacing. On the other hand, the vertically corresponding connecting parts 54 do not contact each other, and are magnetically insulated (see FIG. 24).

Additionally, TOX caulking is, firstly, to overlap two metal plates one after another, then to put the overlapped metal plate materials between a nearly cylindrical protruding portion and a recessed portion capable of fitting to the protruding portion, and then to caulk the metal plate materials by fitting the protruding portion and the recessed portion, with the metal plate material in the protruding portion side stuck out from the circumference due to a groove provided in the circumference of the bottom surface of the recessed portion, and thereby fixing two metal plate materials.

Both the plate shaped composing members 122 and 123 respectively comprise a plurality of plate shaped units 125 connected in the extending direction of the wire 110, and an end plate shaped unit 126 positioned in the end of the plate shaped unit 125 and connected so as to extend in the extending direction of the wire 110.

The plate shaped unit 125 is formed by pressing a metal plate. Three grooves 127 are provided as aligned in the plate shaped unit 125. The cross-section of the groove 127 is formed into a semicircular shape. The plate shaped unit 125 forms a shape corresponding to the shape of each plate shaped composing member 122 and 123. In short, the plate shaped unit 125 for the straight line part in each the plate shaped composing member 122 and 123 forms the straight line shape, while the plate shaped unit 125 for the crooked part in each the plate shaped composing member 122 and 123 forms a crooked shape.

The end plate shaped unit 126 is formed by pressing a metal plate. The end plate shaped unit 126 comprises a main body 128 to be connected with the plate shaped unit 125 and an arcuate part 129 having an arcuate cross-section and outwardly extending in the extending direction of the wire 110 from the main body 128 (the opposite direction from the plate shaped unit 125). Provided as aligned in the main body 128 are three grooves 127. The cross-section of the groove 127 is formed into a semicircular shape. The arcuate part 129 is formed in a shape so as to cross over the grooves 127. This arcuate part 129 forms the above-mentioned connecting part 121 in the pipe 120 in a combined state of both the plate shaped composing members 122 and 123.

The groove 127 formed in the plate shaped unit 125 and the end plate shaped unit 126 is constituted so as to connect with each groove 127 formed in each unit 125 and 126, when each unit 125 and 126 is connected each other along the extending direction of the wire 110. As a result, when the upper plate shaped composing member 122 and the lower plate shaped composing member 123 are formed by connecting the plate shaped unit 125 and the endplate shaped unit 126, the groove-like fitting member 53 is formed in each upper plate shaped composing member 122 and the lower plate shaped composing member 123 by connecting each groove 127.

Figure 21:
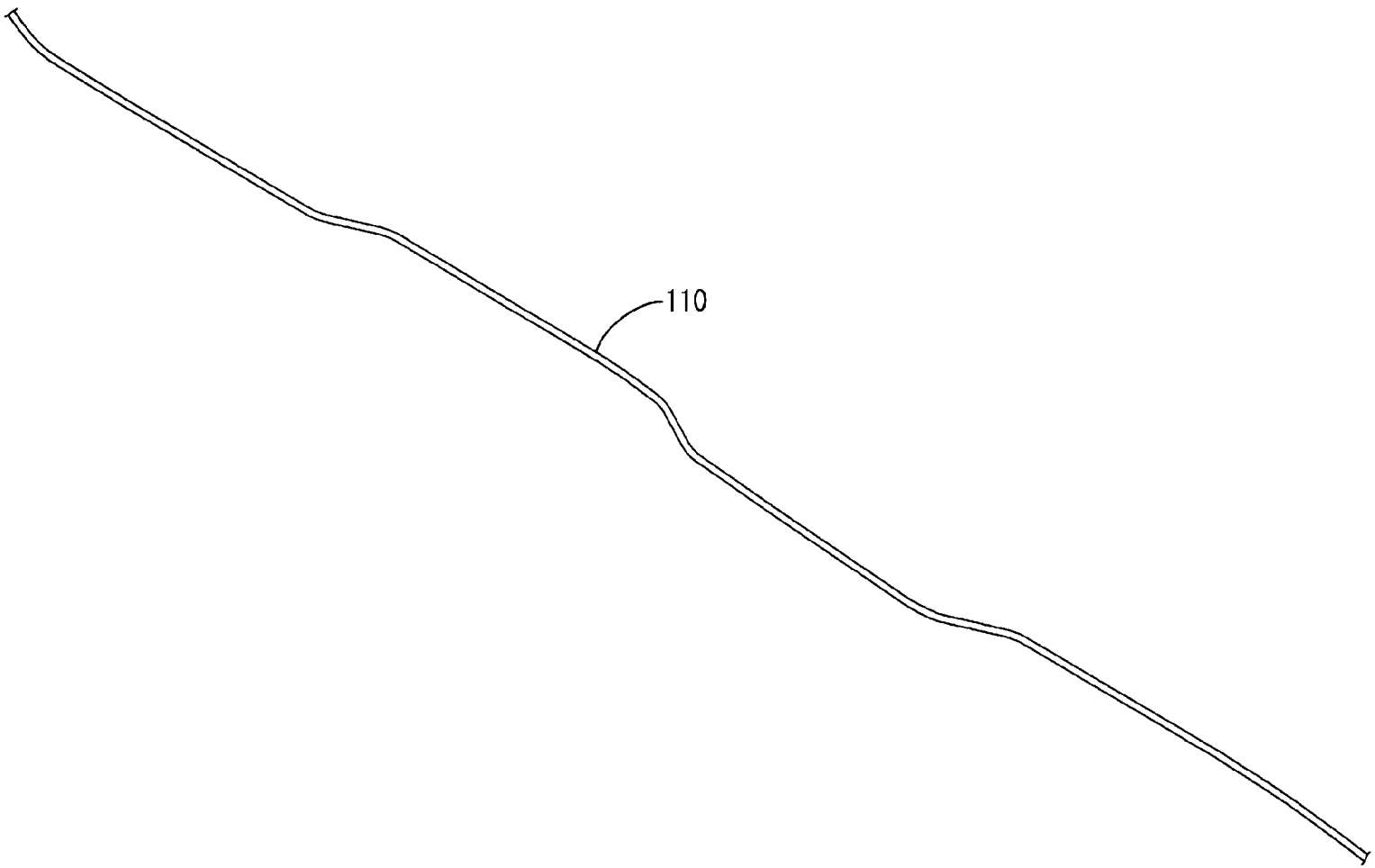
FIG. 21 is a perspective view of a wire in a state before assembling a plate shaped composing member.
Figure 23:
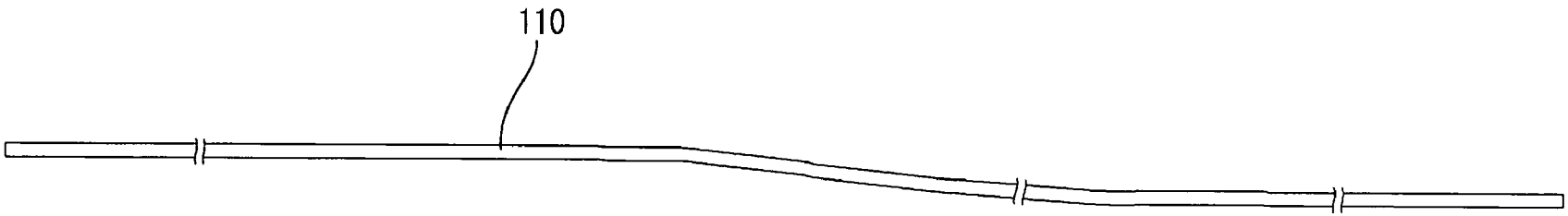
FIG. 23 is a side view showing a wire in a state before assembling a plate shaped composing member.

The wire 110 is constituted from a conductor 111 made of a metallic (for example, aluminum alloy and copper alloy) single core wire, with its circumference enwrapped by an insulating coating 112 made of synthetic resin. The cross-section shape of the conductor 111 and the insulating coating 112 are a perfect circular shape in that of the wire 110. As shown in FIGS. 21 and 23, the wire 110 was bent so as to follow the crooked shape of the pipe 120.

Figure 26:
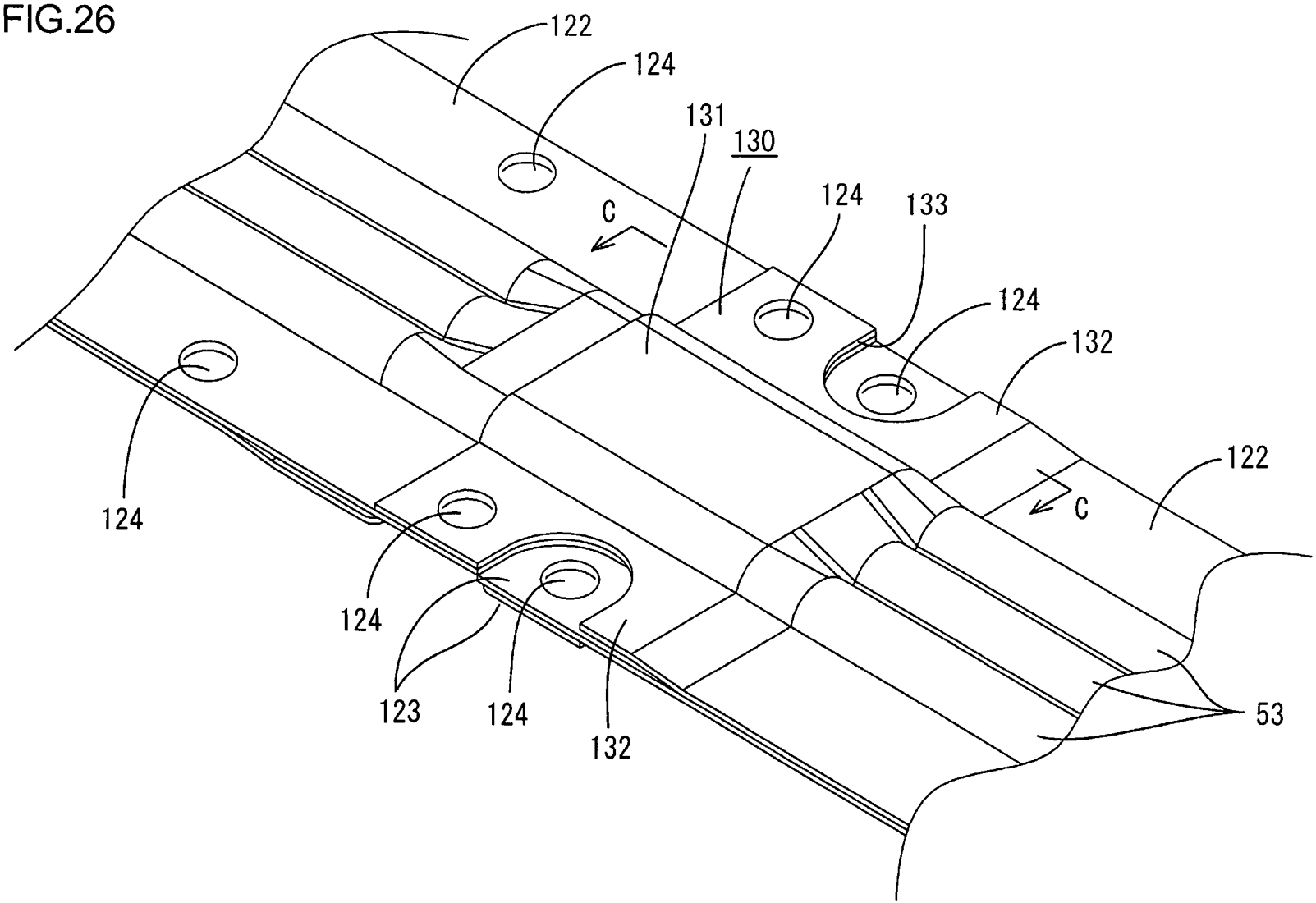
FIG. 26 is an expanded perspective view of a main part of a shield conductor.

The connection structure of each unit 125 and 126 is shown in FIGS. 26 to 29. As shown in FIG. 26, a unit connecting part 130 for connecting each adjacent unit 125 and 126 is formed in both ends of the plate shaped unit 125 and in one end of the end plate shaped unit 126 in the side opposite to the arcuate part 129. The unit connecting part 130 comprises an enwrapping member 131 for collectively enwrapping a plurality of wires 110, formed so as to cross over three grooves 127, and a connecting fringe 132 for connecting with the ear 52, formed in both sides of the enwrapping member 131.

In the connecting part 130 for each adjacent unit 125 and 126, the enwrapping member 131 formed in one unit is formed capable of stacking on the enwrapping member 131 formed in the other unit.

Figure 28:
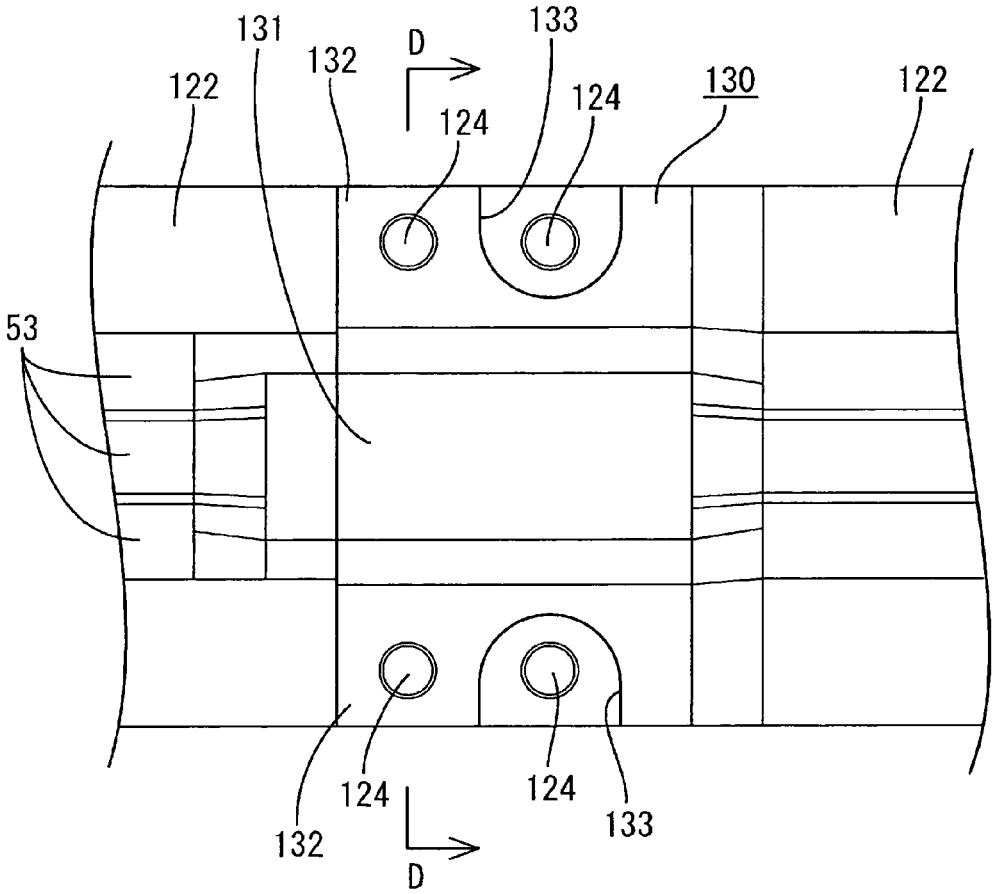
FIG. 28 is an expanded plain view of a main part of a shield conductor.

As shown in FIGS. 26 and 28, in the position closer to the end of the connecting fringe 132, the caulked parts 124 are formed by the above-mentioned TOX caulking. These caulked parts 124 connect the units 125 and 126 constituting the upper plate shaped composing member 122 each other, as well as the units 125 and 126 constituting the lower plate shaped composing member 123 each other.

Figure 27:
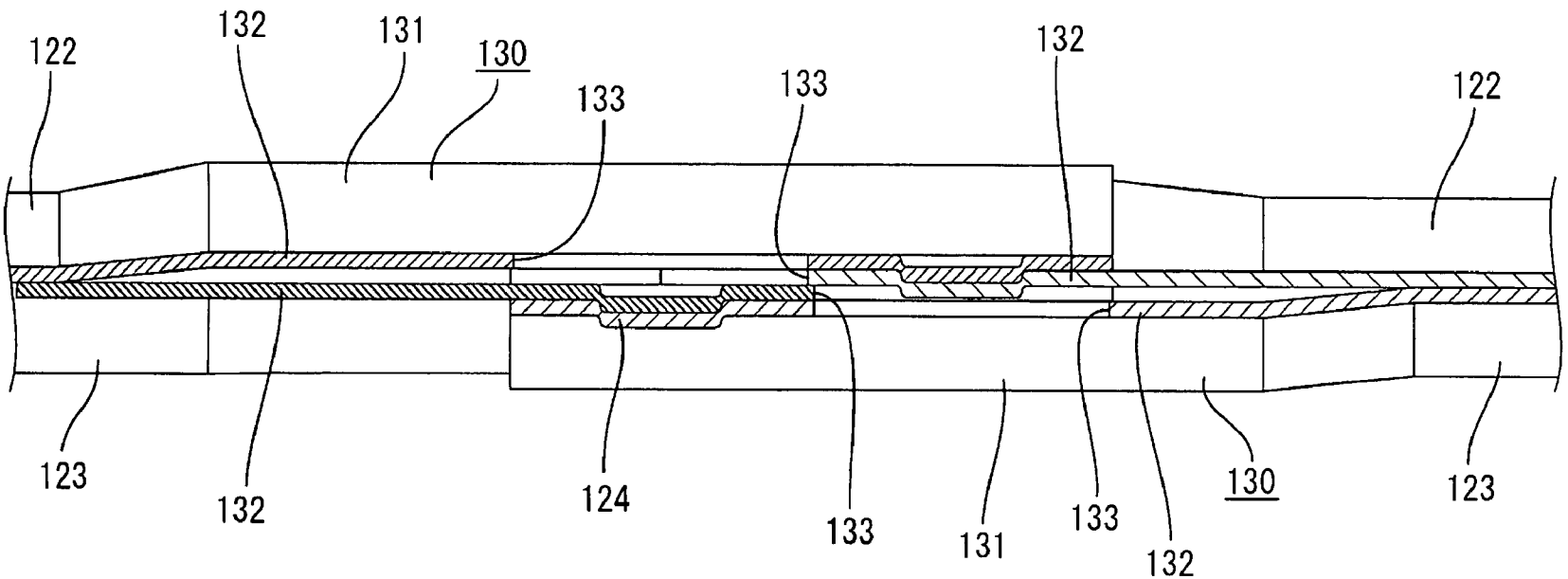
FIG. 27 is a cross-sectional view taken along a line C-C in FIG. 26.
Figure 29:
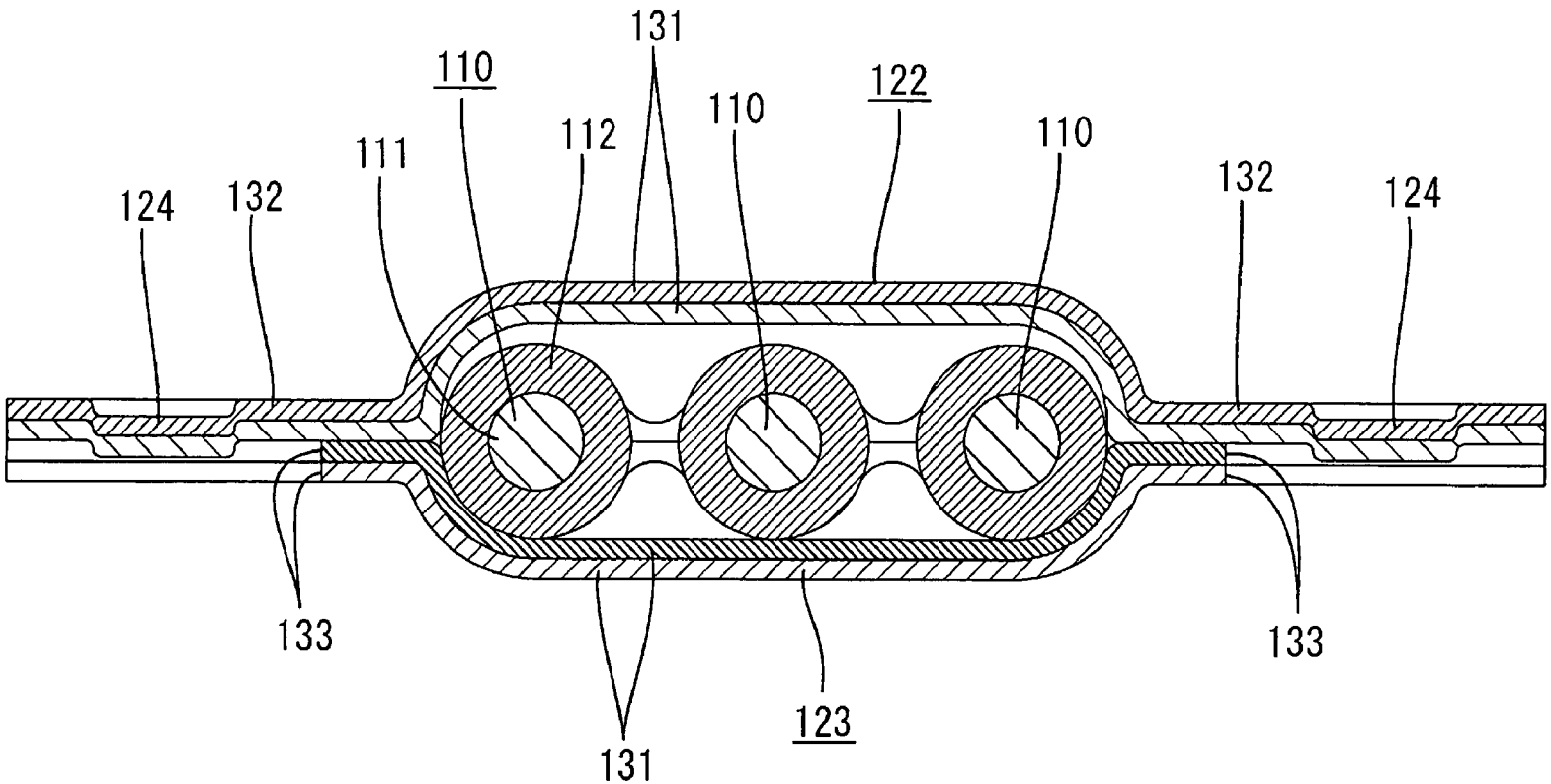
FIG. 29 is a cross-sectional view taken along a line D-D in FIG. 28.

In addition, in the unit connecting part 130, there is formed a notched part 133 notched in a semicircular shape from the side fringe of the connecting fringe 132, between the above-mentioned caulked part 124 and the ear 52. As shown in FIGS. 27 and 29, in a position opposing to the notched part 133 formed in the upper plate shaped composing member 122 side, the caulked part 124 formed in the lower plate shaped composing member 123 side is positioned. On the other hand, in a position opposing the notched part 133 formed in the lower plate shaped composing member 123 side, the caulked part 124 formed in the upper plate shaped composing member 122 side is positioned. This prevents the caulked parts 124 and each plate shaped composing member 122 and 123 from intervening.

Next, a manufacturing process of a shield conductor according to the present embodiment is explained. Firstly, a plurality of plate shaped units 125 are aligned in the extending direction of the wire 110 so that the unit connecting parts 130 in each plate shaped unit 125 are overlapped. Next, in the end of the plate shaped unit 125, the end plate shaped unit 126 is aligned so as to extend in the extending direction of the wire 110.

Conducting TOX caulking to the overlapped connecting fringes 132 connects the plate shaped units 125 and the end plate shaped units 126. This manufactures the upper plate shaped composing member 122 and the lower plate shaped composing member 123.

Next, the wire 110 is bent so as to follow the shape of each plate shaped composing member 122 and 123. Additionally, the bending work of the wire 110 may be performed before manufacturing the plate shaped composing members 122 and 123.

Next, the lower half of the wire 110 is respectively fitted to the three groove-like fitting members 53 in the lower plate shaped composing member 123. In this state, the upper plate shaped composing member 122 is overlapped from above the lower plate shaped composing member 123 with the wires 110 fitted therein. Then, the three groove-like fitting members in the upper plate shaped composing member 122 are externally and respectively fitted to the upper half of the corresponding wires 110. In this state, a slight clearance is formed between the ears 52 in both plate shaped composing members 122 and 123.

Next, as holding the ears 52 each other, TOX caulking is conducted intermittently with a spacing. This electrically connects the ears 52 in both the plate shaped composing members 122 and 123, which have been in a spaced state, rigidly fixed in the caulked parts 124. This completes the shield conductor Wi.

The wire 110 having a single core wire as a conductor 111 like the present embodiment is hard to be bent compared with the wire having a twisted wire as a conductor. Therefore, it is difficult to externally fit the groove-like fitting member 53 to the wire 110, as bending the wire 110 so as to follow the crooked shape of both the plate shaped composing members 122 and 123.

According to the present embodiment, the wire 110 is bent to have a shape following both the plate shaped composing members 122 and 123. Even when both the plate shaped composing members 122 and 123 have a crooked shape, this allows the groove-like fitting member 53 to be easily and externally fitted to the wire 110 having a conductor 111 made of single core wires.

In addition, according to the present embodiment, each plate shaped composing member 122 and 123 having a crooked shape is formed by connecting a plurality of the plate shaped units 125 and the end plate shaped units 126. This achieves downsizing of a mold for the pressing work, compared with a configuration in which each plate shaped composing member 122 and 123 having a crooked shape is formed by pressing, for example, a metal plate material.

Embodiment 10

Figure 30:
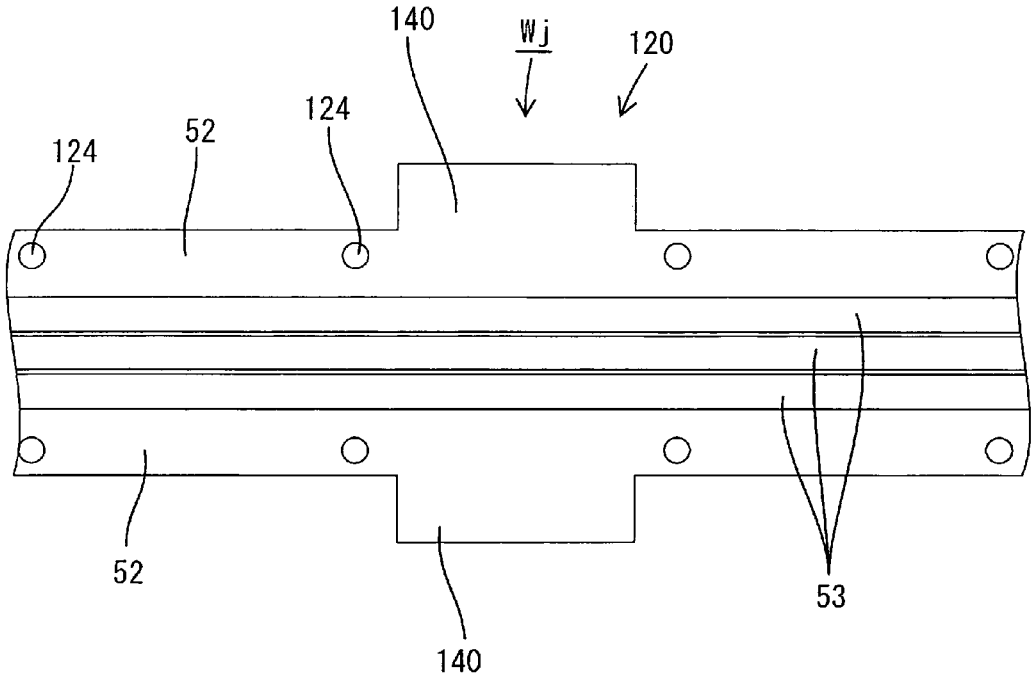
FIG. 30 is an expanded plain view of a main part of a shield conductor according to Embodiment 10.

Next, as referring now to FIG. 30, Embodiment 10 which materializes the present invention is described. In a shield conductor Wj according to the present embodiment, a pair of outwardly protruding flanges 140 is formed in the fringe of the pipe 120. Since the structures other than the above are the same as those in Embodiment 9, the same reference numbers are allotted to those of the corresponding structures, omitting descriptions on constitution, working, and effect.

According to the present embodiment, the shield conductor Wj can be easily mounted in the electric vehicle Ev by fixing the flange 140 to the car body Bd with a clamp not shown.

With embodiments of the present invention described above with reference to the accompanying drawings, it is to be understood that the invention is not limited to those precise embodiments, and the embodiments as below, for example, are within the scope of the present invention.

(1) In the present embodiments, three wires are inserted into the pipe, however, the present invention is not limited to this, and one or two or four wires may be used.

(2) In the present invention, a part of the circumference of the wire may not contact with the inner surface of the plate shaped composing member, in a combined state of a plurality of the plate shaped composing members.

(3) With a plurality of plate shaped composing members externally and individually fitted to the wire, the corresponding abutting members may be abutted or tightly attached each other.

(4) As means for combining the abutting members to each other, a method of spot welding or a method for combining the side fringes in the groove-like fitting members by soldering may be employed.

(5) The connecting part may not exist between adjacent cylindrical parts.

(6) In the above Embodiment 1, the adjacent wires do not contact each other inside the pipe, however, the adjacent wires may be arranged so as to contact each other inside the pipe.

(7) In the above Embodiment 1, a pair of the plate shaped composing members are combined in a direction perpendicular to the arranging direction of the wires, however, the present invention is not limited to this, and a pair of the plate shaped composing members may be combined in a direction parallel to the arranging direction of the wires.

(8) In Embodiment 1, a pair of the plate shaped composing members may be formed in shapes different each other.

(9) In Embodiment 1, the number of the plate shaped composing members constituting the pipe may be three or more.

(10) In Embodiment 2, the number of the plate shaped composing members constituting the pipe may be two, or four or more.

(11) In Embodiment 9, both the plate shaped composing members 122 and 123 are constituted by combining a plurality of plate shaped units 125 and a plurality of the end plate shaped units 126 in the extending direction of the wire 110, however, the present invention is not limited to this, and both the plate shaped composing members 122 and 123 may by formed by pressing one metal plate material into a prescribed shape.

The invention claimed is:

1. A shield conductor comprising:

a metallic pipe, a wire to be inserted into the pipe, and a groove-like fitting member which is provided in the pipe and extends along the direction of axis of the wire, and is securely attached to the circumference of the wire, wherein the pipe is formed by combining a plurality of plate shaped composing members having the groove-like fitting member, and wherein a plurality of the groove-like fitting members are formed in each plate shaped composing member, and a portion positioned between the groove-like fitting members in the plate shaped composing member and the groove-like fitting members in the other plate shaped composing member is in a magnetically-insulated condition.

2. The shield conductor according to claim 1 wherein the wire is used for supplying an electric power for motive power of a vehicle, and the pipe is arranged under the floor of a car body of the vehicle.

3. The shield conductor according to claim 1 wherein the pipe is provided with a plurality of the groove-like fitting members that are attached to the circumference of a plurality of the wires.

4. The shield conductor according to claim 1, wherein the groove-like fitting member forms a cylindrical part enwrapping across a whole circumference of the wire.

5. The shield conductor according to claim 1, wherein an abutting member along a side edge of the plate shaped composing member is formed in the plurality of plate shaped composing members, further wherein in a state where the groove-like fitting member is independently and externally fitted to the wire, the pipe combines the plurality of plate shaped composing members, with the corresponding abutting members fixed to each other in a conductible manner.

6. The shield conductor according to claim 5, wherein the abutting members are fixed to each other by seam welding.

7. The shield conductor according to claim 1, wherein the plate shaped composing member has a crooked shape, while the wire includes a conductor made of single core wires and is bent to have a shape following the plate shaped composing member.

8. The shield conductor according to claim 1, wherein a cross-section shape of the wire is circular, the pipe is formed by combining two plate shaped composing members from the plurality of plate shaped composing members overlapped in the plate thickness direction, and a cross-section shape of the groove-like fitting member in each plate shaped composing member is semicircular.

9. The shield conductor according to claim 1, wherein a cross-section shape of the wire is approximately quadrilateral, and a cross-section shape of the groove-like fitting member in each of the plate shaped composing members is approximately quadrilateral.

10. The shield conductor according to claim 9, wherein the pipe is formed by combining two plate shaped composing members from the plurality of plate shaped composing members overlapped in the plate thickness direction.

11. The shield conductor according to claim 10, wherein the wire has a cross-section of an approximately rectangular shape, and is arranged in a position with respect to the plate shaped composing member so that the thickness direction of the wire and the plate thickness direction of the plate shaped composing member are in the same direction.

12. A shield conductor comprising:

a metallic pipe, a wire to be inserted into the pipe, and a groove-like fitting member which is provided in the pipe and extends along the direction of axis of the wire, and is securely attached to the circumference of the wire, wherein the pipe is formed by combining two plate shaped composing members overlapped in the plate thickness direction, and one plate shaped composing member is a flat plate, while the other plate shaped composing member is formed with the groove-like fitting member, and wherein a plurality of the groove-like fitting members are formed in the plate shaped composing member formed with the groove-like fitting member, and a portion positioned between the groove-like fitting members in the plate shaped composing member is in a magnetically-insulated condition.

13. A shield conductor comprising:

a metallic pipe, a wire to be inserted into the pipe, and a groove-like fitting member which is provided in the pipe and extends along the direction of axis of the wire, and is securely attached to the circumference of the wire, wherein the pipe is formed with one plate shaped composing member folded back approximately at the center, and wherein a plurality of the groove-like fitting members are formed in the plate shaped composing member, and a portion positioned between the groove-like fitting members in the plate shaped composing member is in a magnetically-insulated condition.

14. A shield conductor manufacturing method, comprising the steps of:

forming a plurality of metallic plate shaped composing members having a plurality of groove-like fitting members, externally fitting the groove-like fitting members to a wire, and constituting a pipe by combining the plate shaped composing members so as to enwrap the wire and by bringing the plurality of plate shaped composing members together so that a portion positioned between the groove-like fitting members in the plate shaped composing member and the groove-like fitting members in the other plate shaped composing member is in a magnetically-insulated condition.

15. The shield conductor manufacturing method according to claim 14, further including:

forming an abutting member along a side edge of the plate shaped composing member in the plurality of plate shaped composing members, externally and individually fitting the plurality of plate shaped composing members to the wire, and constituting the pipe by bringing the abutting members closer to each other and fixing them conductibly and rigidly so that the plurality of plate shaped composing members are combined.

16. The shield conductor manufacturing method according to claim 15, further including rigidly fixing the corresponding abutting members each other by seam welding.

17. The shield conductor manufacturing method according claim 14 which executes:

a process for forming the plate shaped composing member into a crooked shape, a process for bending the wire including a single core wire so as to follow a shape of the plate shaped composing member, and a process for externally fitting the groove-like fitting member to the wire bent by the bending.

* * * * *